US011507001B2

(12) United States Patent
Yoshida et al.

(10) Patent No.: US 11,507,001 B2
(45) Date of Patent: Nov. 22, 2022

(54) IMAGE FORMING APPARATUS INCLUDING A PLURALITY OF HEAT GENERATING ELEMENTS

(71) Applicant: Canon Kabushiki Kaisha, Tokyo (JP)

(72) Inventors: Tsuguhiro Yoshida, Yokohama (JP); Kazuhiro Doda, Yokohama (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/370,241

(22) Filed: Jul. 8, 2021

(65) Prior Publication Data

US 2021/0333732 A1 Oct. 28, 2021

Related U.S. Application Data

(63) Continuation of application No. 17/007,259, filed on Aug. 31, 2020, now Pat. No. 11,092,916.

(30) Foreign Application Priority Data

Sep. 6, 2019 (JP) ..... JP2019-162958

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/2064* (2013.01); *G03G 15/5004* (2013.01); *G03G 15/80* (2013.01); *G03G 2215/00734* (2013.01); *G03G 2215/2038* (2013.01)

(58) Field of Classification Search
USPC ..... 399/63
See application file for complete search history.

(56) References Cited

U.S. PATENT DOCUMENTS

| | | | | |
|---|---|---|---|---|
| 2013/0071134 | A1 | 3/2013 | Hikari et al. | |
| 2013/0322908 | A1 | 12/2013 | Ogura | |
| 2017/0185016 | A1* | 6/2017 | Kadowaki ..... | G03G 15/2042 |
| 2020/0165885 | A1 | 5/2020 | Horst et al. | |

FOREIGN PATENT DOCUMENTS

| | | | |
|---|---|---|---|
| JP | 2009251137 | A | 10/2009 |
| JP | 2013235181 | A | 11/2013 |
| JP | 2015072443 | A | 4/2015 |
| JP | 2019032356 | A | 2/2019 |

* cited by examiner

*Primary Examiner* — Quana Grainger
(74) *Attorney, Agent, or Firm* — Venable LLP

(57) ABSTRACT

An image forming apparatus is operable in a first small-sheet printing in which power is supplied to the first heat generating element and the second heat generating element and in a second small-sheet printing in which power is supplied to the first heat generating element and the third heat generating element. A first power ratio, which is a proportion of power supplied to the first heat generating element to power supplied to the second heat generating element in the first small-sheet printing, is higher than a second power ratio, which is a proportion of power supplied to the first heat generating element to power supplied to the third heat generating element in the second small-sheet printing.

14 Claims, 10 Drawing Sheets

IMAGE FORMING APPARATUS INCLUDING A PLURALITY OF HEAT GENERATING ELEMENTS

CROSS-REFERENCE TO RELATED APPLICATIONS

This application is a Continuation of U.S. patent application Ser. No. 17/007,259, filed Aug. 31, 2020, which claims the benefit of Japanese Patent Application No. 2019-162958, filed Sep. 6, 2019. The entire contents of these applications are hereby incorporated by reference herein.

BACKGROUND OF THE INVENTION

Field of the Invention

The present invention relates to an image forming apparatus employing electrophotography, for example, a copying machine or a printer.

Description of the Related Art

In some related-art image forming apparatuses, a fixing device including a plurality of heat generating elements of varying lengths is installed. There has been disclosed a configuration in which a temperature rise in a non-sheet passing portion is prevented by switching the heat generating element to which power is to be supplied and thus selectively using a heat generating element of a length suitable for the sheet size (see, for example, Japanese Patent Application Laid-Open No. 2013-235181). "Temperature rise in a non-sheet passing portion" refers to a phenomenon observed during fixing processing performed on a sheet P whose width is less than the length of the heat generating element in a longitudinal direction, in the form of a rise in temperature in a non-sheet passing portion, in which the sheet has no contact with the heat generating element.

In printing on a small-width sheet, fixing processing is enabled by heating the recording material with a heat generating element small in width when the fixing device is sufficiently warm (warmed up). When the fixing device is not sufficiently warm, however, the use of a heat generating element large in width may be required even for fixing processing on a small-width sheet, to prevent the deformation of a fixing film. The temperature rise in a non-sheet passing portion is large in this case due to fixing processing performed on a small-width sheet with a heat generating element large in width. A temperature rise in a non-sheet passing portion that is excessively large deteriorates a member of a non-sheet passing portion, which may cause image defects, and fixing processing performed on a large-width sheet immediately after may cause hot offset in a non-sheet passing portion area of the small-width sheet on which immediately preceding fixing processing has been performed.

SUMMARY OF THE INVENTION

An image forming apparatus according to an embodiment of the present invention includes: a fixing device including a heater, a first rotary member, a second rotary member, and a temperature detection unit, the heater including a first heat generating element, a second heat generating element shorter in length in a longitudinal direction than the first heat generating element, and a third heat generating element shorter in length in the longitudinal direction than the second heat generating element, the first rotary member being heated by the heater, the second rotary member forming a nip portion together with the first rotary member; and a control unit configured to control a temperature of the heater based on a detection result of the temperature detection unit, wherein the image forming apparatus is operable in a first mode in which power is supplied to the first heat generating element and the second heat generating element and in a second mode in which power is supplied to the first heat generating element and the third heat generating element, and wherein a first power ratio, which is a proportion of power supplied to the first heat generating element to power supplied to the second heat generating element in the first mode, is higher than a second power ratio, which is a proportion of power supplied to the first heat generating element to power supplied to the third heat generating element in the second mode.

Further features of the present invention will become apparent from the following description of exemplary embodiments with reference to the attached drawings.

DESCRIPTION OF THE EMBODIMENTS

Embodiments of the present invention are described below with reference to the drawings. In the following Embodiments, running a recording sheet through a fixing nip portion is referred to as "passing a sheet". An area in which a heat generating element generates heat and through which a recording sheet does not pass is referred to as "non-sheet passing area" (or "non-sheet passing portion"). An area in which a heat generating element generates heat and through which a recording sheet passes is referred to as "sheet passing area" (or "sheet passing portion"). A phenomenon in which the temperature in the non-sheet passing area rises higher than the temperature in the sheet passing area is referred to as "temperature rise in a non-sheet passing portion".

Embodiment 1

<Overall Configuration>

Figure 1:
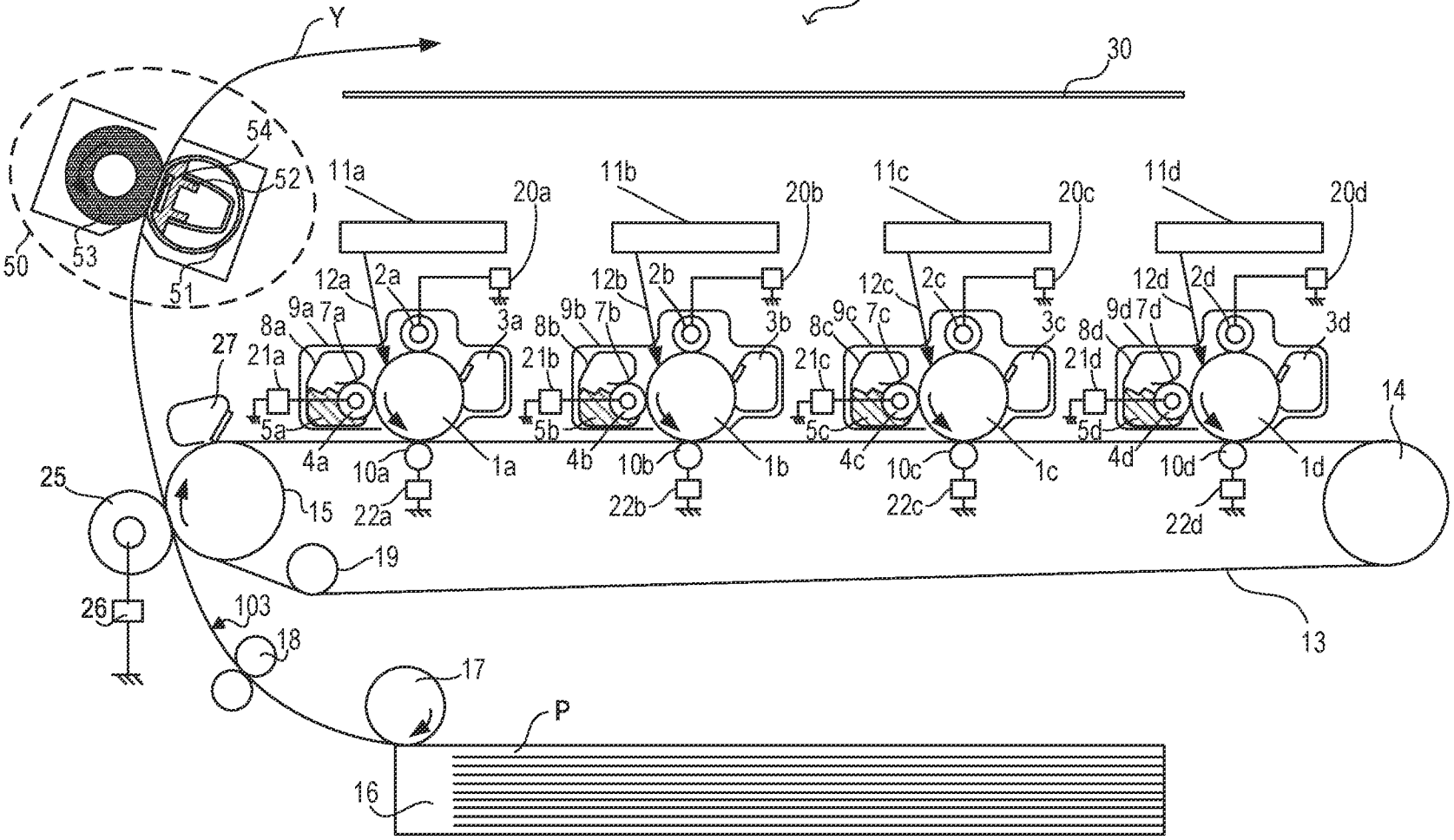
FIG. 1 is a sectional view for illustrating a configuration of an image forming apparatus according to Embodiment 1 and Embodiment 2.

FIG. 1 is a diagram for illustrating a configuration of an in-line color-image forming apparatus 170, which is an example of an image forming apparatus 170 with a fixing device installed therein according to Embodiment 1. The operation of the color-image forming apparatus 170 as an electrophotographic apparatus is described with reference to FIG. 1. A first station is a station for forming a yellow (Y) color toner image, and a second station is a station for forming a magenta (M) color toner image. A third station is a station for forming a cyan (C) color toner image, and a fourth station is a station for forming a black (K) color toner image.

At the first station, a photosensitive drum 1*a*, which is an image bearing member, is an OPC photosensitive drum. The photosensitive drum 1*a* is a metal cylinder on which a plurality of layers of functional organic materials are laminated. The plurality of layers include a carrier generation layer, which generates electric charges by photosensitivity, a charge transport layer, through which the generated electric charges are transported, and others, and the outermost layer of the plurality of layers is so low in electrical conductance that the outermost layer is substantially insulating. A charging roller 2*a*, which is a charging unit, is brought into contact with the photosensitive drum 1*a*, and follows the rotation of the photosensitive drum 1*a* to rotate and uniformly charge a surface of the photosensitive drum 1*a* during the rotation. A voltage on which a direct-current voltage or an alternating current voltage is superposed is applied to the charging roller 2*a*, and the resultant electric discharge occurring in minute air gaps on the upstream side and the downstream side in the direction of the rotation from a nip portion between the charging roller 2*a* and the surface of the photosensitive drum 1*a* charges the photosensitive drum 1*a*. A cleaning unit 3*a* is a unit configured to clean toner remaining on the photosensitive drum 1*a* after transfer, which is described later. A developing unit 8*a*, which is a unit configured to develop an image, includes a developing roller 4*a*, a non-magnetic one-component toner 5*a*, and a developer application blade 7*a*. The photosensitive drum 1*a*, the charging roller 2*a*, the cleaning unit 3*a*, and the developing unit 8*a* are in an integrated process cartridge 9*a*, which can freely be attached to and detached from the image forming apparatus 170.

An exposure device 11*a*, which is an exposure unit, includes a scanner unit using a polygonal mirror to scan laser light, or a light emitting diode (LED) array, and radiates a scanning beam 12*a*, which is modulated based on an image signal, on the photosensitive drum 1*a*. The charging roller 2*a* is connected to a charging high-voltage power source 20*a*, which is a unit configured to supply a voltage to the charging roller 2*a*. The developing roller 4*a* is connected to a development high-voltage power source 21*a*, which is a unit configured to supply a voltage to the developing roller 4*a*. A primary transfer roller 10*a* is connected to a primary transfer high-voltage power source 22*a*, which is a unit configured to supply a voltage to the primary transfer roller 10*a*. This concludes the description on the configuration of the first station, and the second, third, and fourth stations have the same configuration as that of the first station. In the other stations, parts having the same functions as those of the parts in the first station are denoted by the same reference symbols, with one of suffixes "b", "c", and "d" attached to the reference symbols for each station. The suffixes "a", "b", "c", and "d" are omitted in the following description, except for when a specific station is described.

An intermediate transfer belt 13 is supported by three rollers: a secondary transfer counter roller 15, a tension roller 14, and an auxiliary roller 19, which serve as tension members for the intermediate transfer belt 13. A force from a spring is applied to the tension roller 14 alone in a direction that causes the intermediate transfer belt 13 to stretch, so that an appropriate tensional force is maintained in the intermediate transfer belt 13. The secondary transfer counter roller 15 is rotationally driven by a main motor (not shown) to rotate, which causes the intermediate transfer belt 13 wound around the outer circumference of the secondary transfer counter roller 15 to turn. The intermediate transfer belt 13 moves in a forward direction (for example, the clockwise direction in FIG. 1) in relation to the photosensitive drums 1*a* to 1*d* (rotating, for example, in the counterclockwise direction in FIG. 1) at substantially the same speed. The intermediate transfer belt 13 also rotates in the direction of the arrow (the clockwise direction), and the primary transfer roller 10 placed on the opposite side from the photosensitive drum 1 across the intermediate transfer belt 13 follows the movement of the intermediate transfer belt 13 to rotate. A position at which the photosensitive drum 1 and the primary transfer roller 10 come into contact with each other with the intermediate transfer belt 13 interposed therebetween is referred to as "primary transfer position". The auxiliary roller 19, the tension roller 14, and the secondary transfer counter roller 15 are electrically grounded. The primary transfer rollers 10*b* to 10*d* in the second to fourth stations have the same configuration as that of the primary transfer roller 10*a* in the first station, and a description thereof is therefore omitted.

Image forming operation of the image forming apparatus 170 according to Embodiment 1 is described next. The image forming apparatus 170 starts image forming operation when receiving a print command in a standby state. The main motor (not shown) causes the photosensitive drums 1, the intermediate transfer belt 13, and others to start rotating in the directions of the arrows at a given process speed. The photosensitive drum 1*a* is uniformly charged by the charging roller 2*a*, to which a voltage has been applied by the charging high-voltage power source 20*a*, and an electrostatic latent image based on image information (also referred to as "image data") is subsequently formed with the scanning beam 12*a* radiated from the exposure device 11*a*. The toner 5*a* inside the developing unit 8*a* is charged to have a negative polarity by the developer application blade 7*a*, and then applied to the developing roller 4*a*. A given development voltage is supplied to the developing roller 4*a* from the development high-voltage power source 21*a*. With the rotation of the photosensitive drum 1*a*, the electrostatic latent image formed on the photosensitive drum 1*a* reaches the developing roller 4*a*, at which the negative toner adheres to the electrostatic latent image, to thereby turn the latent image into a visible toner image that is formed in the first color (for example, yellow (Y)) on the photosensitive drum 1*a*. The same operation is executed at the stations (the process cartridges 9*b* to 9*d*) of the other colors (magenta (M), cyan (C), and black (K)) as well. An electrostatic latent image is formed on each of the photosensitive drums 1*a* to 1*d* by exposure, with a write signal from a controller (not shown) delayed at fixed timing that is based on the distance between the primary transfer position of one color and the primary transfer position of another color. A direct-current high voltage having a polarity opposite to that of the toner is applied to each of the primary transfer rollers 10*a* to 10*d*. Through the steps described above, toner images are sequentially transferred to the intermediate transfer belt 13 (hereinafter referred to as "primary transfer") to form a multiple toner image on the intermediate transfer belt 13.

Thereafter, a sheet P, which is one of recording materials stacked in a cassette 16, is conveyed along a conveyance path Y with the progress of the forming of toner images. Specifically, the sheet P is fed (picked up) by a sheet feeding roller 17, which is rotationally driven by a sheet feeding solenoid (not shown). The fed sheet P is conveyed by a conveying roller to registration rollers 18. A registration sensor 103 is placed downstream of the registration rollers 18. The registration sensor 103 detects the "presence" of the sheet P when the front end of the sheet P reaches the registration sensor 103, and detects the "absence" of the sheet P when the rear end of the sheet P passes the registration sensor 103.

The sheet P is conveyed by the registration rollers 18 to a transfer nip portion at which the intermediate transfer belt 13 and the secondary transfer roller 25 come into contact with each other, in synchronization with the toner image on the intermediate transfer belt 13. A voltage having a polarity opposite to that of the tone is applied to the secondary transfer roller 25 by the secondary transfer high-voltage power source 26 to transfer the multiple toner image born on the intermediate transfer belt 13, which is a stack of toner images each having one of four colors, at once onto the sheet P (a recording material) (hereinafter referred to as "secondary transfer"). The members that have participated up through the forming of an unfixed toner image on the sheet P (for example, the photosensitive drums 1) function as an image forming unit. The toner remaining on the intermediate transfer belt 13 after the secondary transfer is finished is cleaned off by the cleaning unit 27. The sheet P after the completion of the secondary transfer is conveyed to a fixing device 50, which is a fixing unit, and once the toner image is fixed, is discharged as an image-formed product (a print or a copy) to a discharge tray 30. The length of time from the start of the image forming operation until the arrival of the sheet P at the fixing nip portion is, for example, approximately 9 seconds, and the length of time until the discharge of the sheet P is, for example, approximately 12 seconds. A film 51, nip forming member 52, pressure roller 53, and heater 54 of the fixing device 50 are described later.

A print mode in which images are printed on a plurality of sheets P in succession is hereinafter referred to as "consecutive printing" or "consecutive job". In consecutive printing, the space between the rear end of the sheet P on which printing is performed earlier than another sheet (hereinafter referred to as "preceding sheet") and the front end of the sheet P on which printing is performed subsequently to the printing on the preceding sheet (hereinafter referred to as "following sheet") is referred to as "sheet interval". In Embodiment 1, consecutive printing on A4-sized sheets is performed by conveying each sheet P in synchronization with a toner image on the intermediate transfer belt 13 so that the sheet-to-sheet distance is, for example, 30 mm. The image forming apparatus 170 according to Embodiment 1 is the center-oriented image forming apparatus 170 in which printing operation is executed with center positions of the members and each sheet P aligned in a direction (a longitudinal direction described later) orthogonal to the conveyance direction. The center position of each sheet P accordingly matches irrespective of whether the printing operation is executed for the sheet P that is long in the direction orthogonal to the conveyance direction or for the sheet P that is short in the direction orthogonal to the conveyance direction.

[Block Diagram of Image Forming Apparatus]

Figure 2:
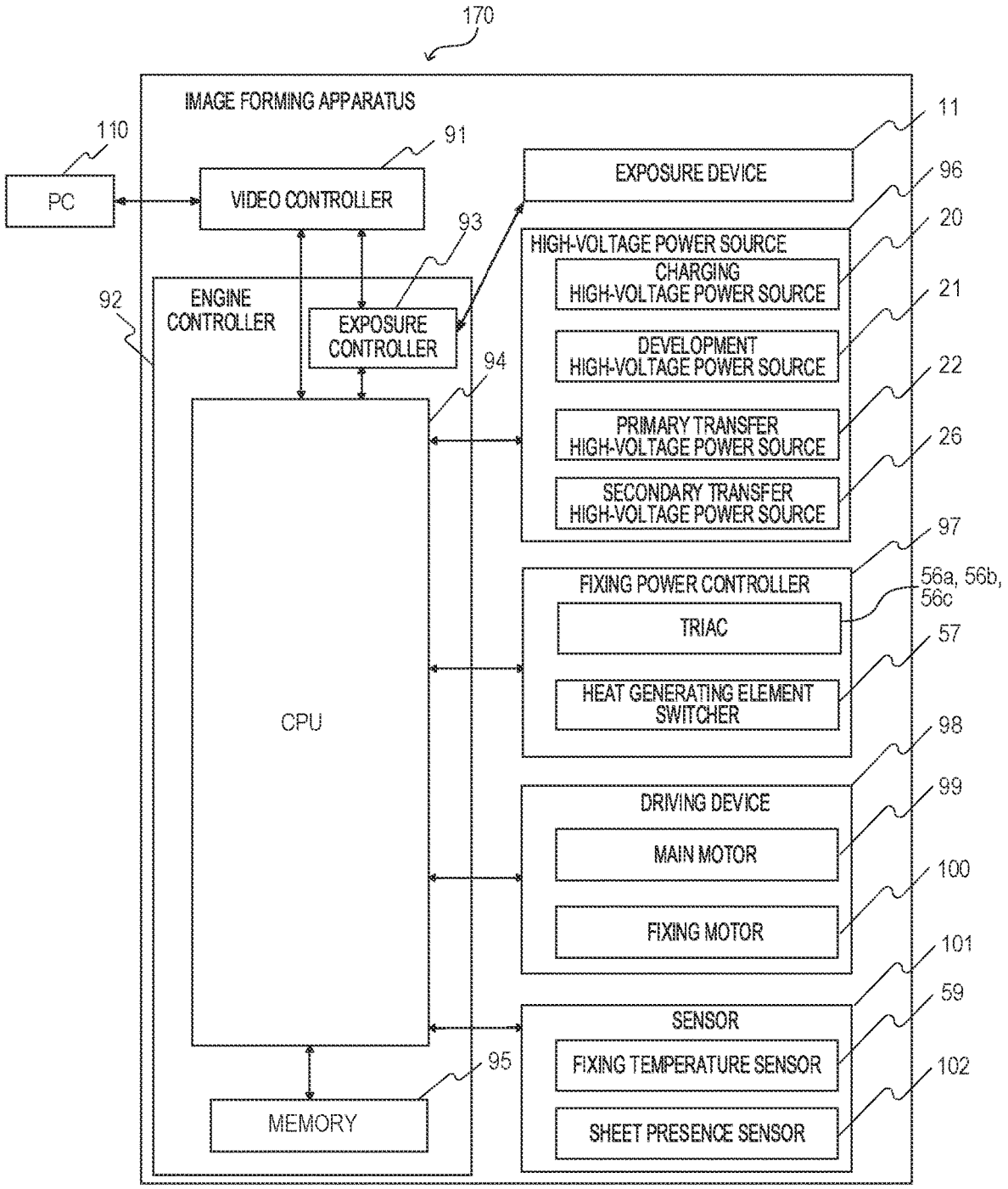
FIG. 2 is a block diagram of the image forming apparatus according to Embodiment 1 and Embodiment 2.

FIG. 2 is a block diagram for illustrating the operation of the image forming apparatus 170, and printing operation of the image forming apparatus 170 is described with reference to FIG. 2. A PC 110 serving as a host computer has the role of outputting a print command to a video controller 91, which is located inside the image forming apparatus 170, and transferring image data of a print image to the video controller 91.

The video controller 91 converts the image data input from the PC 110 into exposure data, and it transfers the exposure data to an exposure controller 93 located inside the engine controller 92. The exposure controller 93 is controlled by a CPU 94 to control the on/off of the exposure data and the exposure device 11. The size of the exposure data is determined by the image size. The CPU 94, which is a control unit, starts an image forming sequence when receiving the print command.

An engine controller 92 in which a CPU 94, a memory 95, and others are installed executes pre-programmed operation. A high-voltage power source 96 includes the charging high-voltage power source 20, development high-voltage power source 21, primary transfer high-voltage power source 22, and secondary transfer high-voltage power source 26 described above. A fixing power controller 97 includes three bidirectional thyristors (hereinafter also referred to as "triacs") 56*a*, 56*b*, and 56*c*. The fixing power controller 97 also includes, among others, a heat generating element switcher 57, which is a switching unit configured to switch between a heat generating element 54*b*2 and a heat generating element 54*b*3 by switching a power supply path that is used to supply power. The fixing power controller 97 selects a heat generating element that generates heat in the fixing device 50, and it determines the amount of power to be supplied. In Embodiment 1, the heat generating element switcher 57 is, for example, a normally open relay.

A driving device 98 includes a main motor 99, a fixing motor 100, and others. A sensor 101 includes a fixing temperature sensor 59, which detects the temperature of the fixing device 50, a sheet presence sensor 102, which has a flag and detects the presence/absence of the sheet P, and others. Detection results of the sensor 101 are transmitted to the CPU 94. The registration sensor 103 is included in the sheet presence sensor 102 in some cases. The CPU 94 obtains the detection results of the sensor 101 in the image forming apparatus 170 to control the exposure device 11, the high-voltage power source 96, the fixing power controller 97, and the driving device 98. The CPU 94 thus controls an image forming step in which the forming of an electrostatic latent image, the transfer of a developed toner image, and the fixing of the toner image to the sheet P are executed to print exposure data as a toner image on the sheet P. An image forming apparatus to which the present invention is applied is not limited to the image forming apparatus 170 that has the configuration illustrated in FIG. 1, and can be any image forming apparatus as long as printing on sheets P of varying widths is executable and the image forming apparatus includes the fixing device 50 that includes the heater 54 described later.

[Fixing Device]

Figure 3:
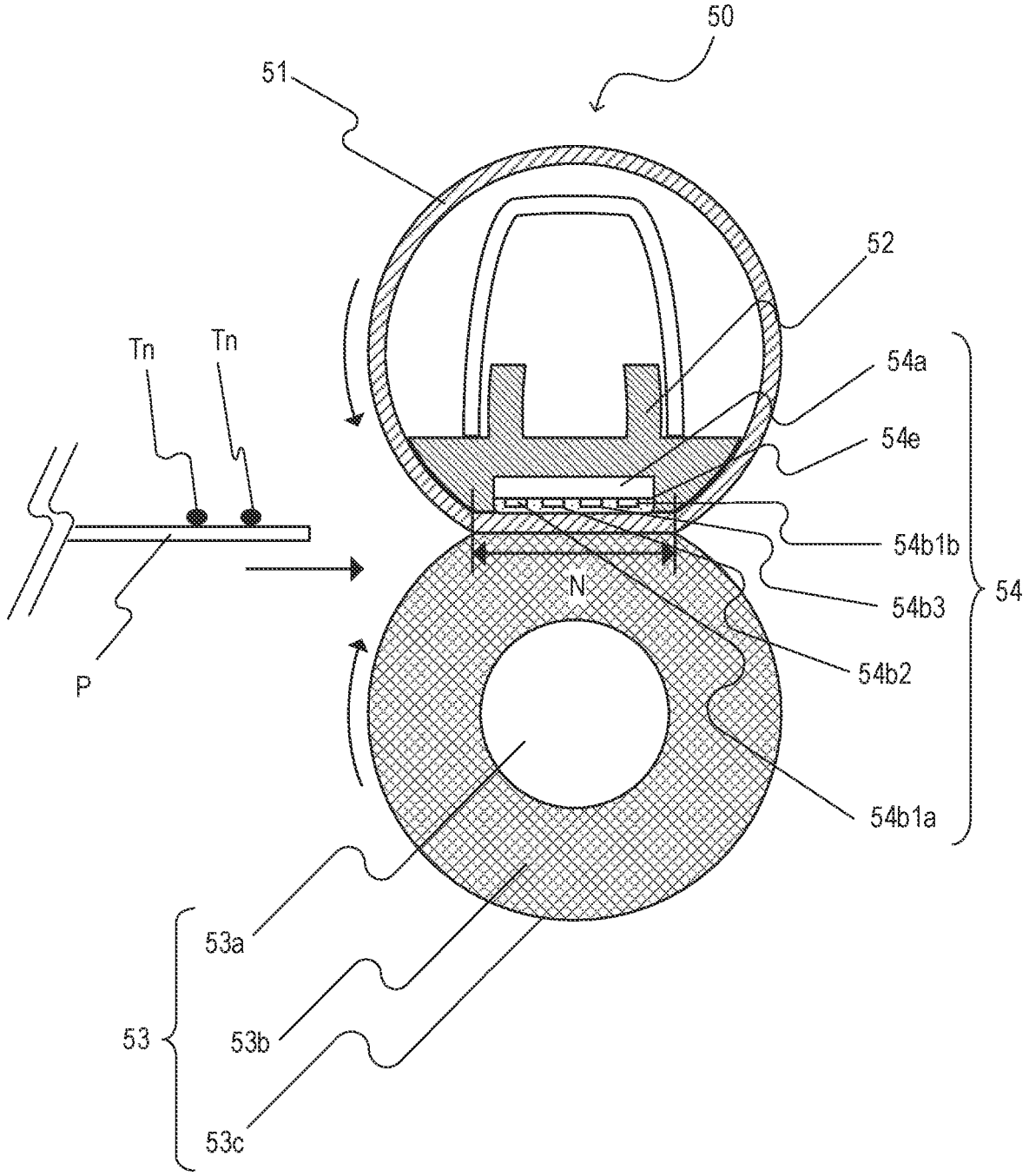
FIG. 3 is a schematic sectional view of a central part in a longitudinal direction of a fixing device in Embodiment 1 and Embodiment 2, and a part around the central part.
Figure 4A:
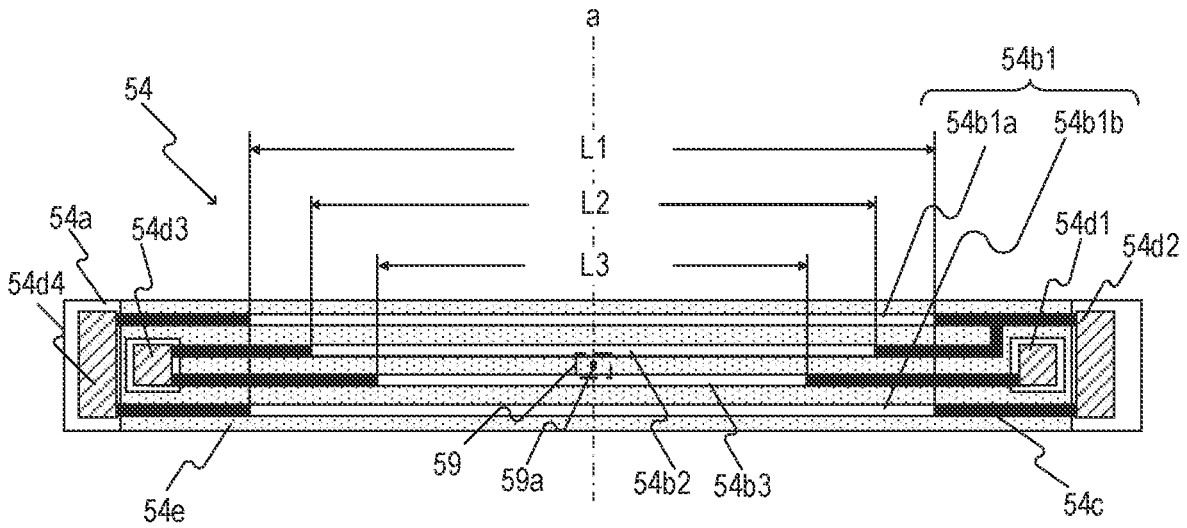
FIG. 4A and FIG. 4B are schematic diagrams of a heater in Embodiment 1 and Embodiment 2.
Figure 4B:
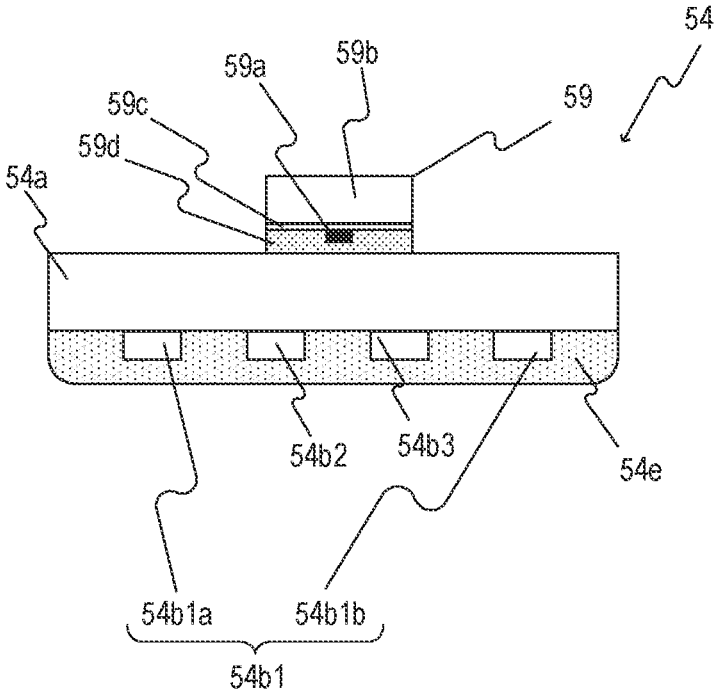
Figure 5:
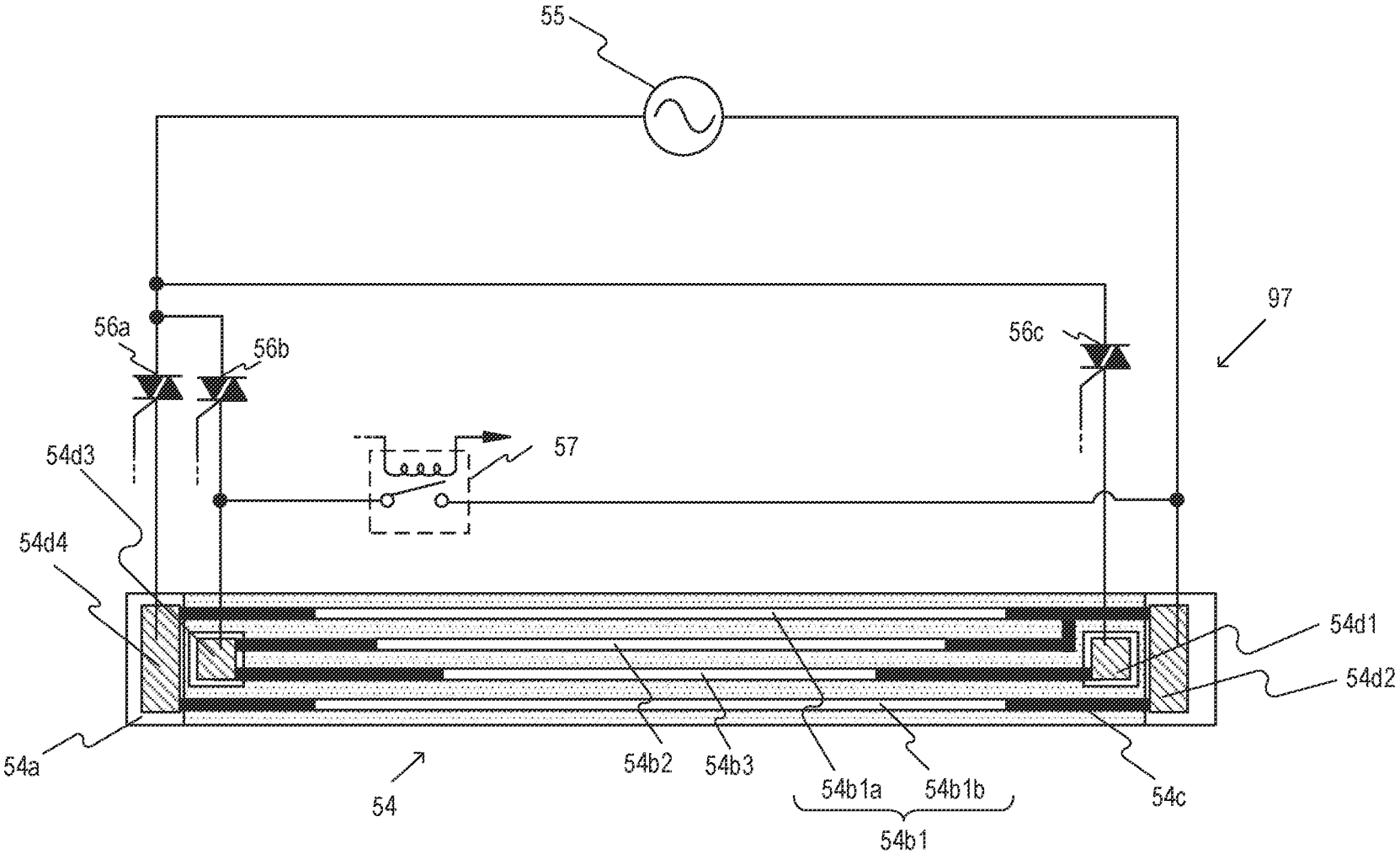
FIG. 5 is a schematic diagram of a power control circuit in Embodiment 1.

A configuration of the fixing device 50 in Embodiment 1 is described next with reference to FIG. 3. The longitudinal direction is a rotation axis direction of the pressure roller 53 described later, which is substantially orthogonal to the conveyance direction of the sheet P. The length of the sheet P and the lengths of the heat generating elements in the direction (the longitudinal direction) substantially orthogonal to the conveyance direction are referred to as "widths". FIG. 3 is a schematic sectional view of the fixing device 50. FIG. 4A is a schematic diagram of the heater 54, FIG. 4B is a schematic sectional view of the heater 54, and FIG. 5 is a schematic circuit diagram of the fixing power controller 97 of the heater 54 of the fixing device 50. FIG. 4B is a sectional view of the heater 54 taken along a center line of heat generating elements 54*b*1*a*, 54*b*1*b*, 54*b*2 and 54*b*3 in the longitudinal direction, which is a center line (the dot-dash line "a" in FIG. 4A) of the sheet P conveyed to the fixing device 50 in the longitudinal direction. In the following description, the line "a" is referred to as "reference line "a"".

The sheet P holding an unfixed toner image Tn is conveyed from the left hand side toward the right hand side in FIG. 3, and is heated in a fixing nip portion N during the conveyance, to thereby fix the toner image Tn on the sheet P. The fixing device 50 in Embodiment 1 includes the film 51 shaped into a tube, the nip forming member 52 configured to hold the film 51, the pressure roller 53, which forms the fixing nip portion N together with the film 51, and the heater 54 for heating the sheet P.

The film 51, which is a first rotary member, is a fixing film serving as a heating rotary member. In Embodiment 1, the film 51 has a base layer made of, for example, polyimide. On the base layer, an elastic layer is made of silicone rubber and a release layer is made of PFA. The inner diameter of the film 41 is 18 mm and the outer circumference length of the film 51 is approximately 58 mm. The inner surface of the film 51 is coated with grease in order to reduce a frictional force generated between the nip forming member 52, the heater 54, and the film 51 by the rotation of the film 51.

The nip forming member 52 plays the role of guiding the film 51 from the inside and forming the fixing nip portion N between the nip forming member 52 and the pressure roller 53 via the film 51. The nip forming member 52 is a member that has rigidity, heat resistance, and heat insulation, and is formed of liquid crystal polymer or the like. The film 51 is fit to the exterior of the nip forming member 52. The pressure roller 53, which is a second rotary member, is a roller serving as a pressurizing rotary member. The pressure roller 53 includes a metal core 53*a*, an elastic layer 53*b*, and a release layer 53*c*. The pressure roller 53 is rotatably held at both ends, and it is rotationally driven by the fixing motor 100 (see FIG. 2). The film 51 follows the rotation of the pressure roller 53 to rotate. The heater 54, which is a heating member, is held by the nip forming member 52 so as to be in contact with the inner surface of the film 51. A substrate 54*a*, the heat generating elements 54*b*1*a* (54*b*1), 54*b*1*b* (54*b*1), 54*b*2, and 54*b*3, a protection glass layer 54*e*, and the fixing temperature sensor 59 are described later.

(Heater)

The heater 54 is described in detail with reference to FIG. 4A. The heater 54 is formed of a substrate 54*a*, the heat generating element 54*b*1*a* being a first heat generating element, the heat generating element 54*b*1*b* being a fourth heat generating element, the heat generating element 54*b*2 being a second heat generating element, the heat generating element 54*b*3 being a third heat generating element, a conductor 54*c*, contacts 54*d*1 to 54*d*4, and a protection glass layer 54*e*. In the following, the heat generating elements 54*b*1*a*, 54*b*1*b*, 54*b*2, and 54*b*3 are collectively referred to as heat generating elements 54*b* in some parts. Moreover, the heat generating elements 54*b*1*a* and 54*b*1*b* having substantially the same length in the longitudinal direction are collectively referred to as heat generating elements 54*b*1. The substrate 54*a* is made of alumina ($Al_2O_3$) being ceramics. As materials of the ceramic substrate, for example, alumina ($Al_2O_3$), aluminum nitride (AlN), zirconia ($ZrO_2$), and silicon carbide (SiC) are widely known. Among those materials, alumina ($Al_2O_3$) is low in price and can industrially be obtained with ease. Moreover, a metal which is excellent in strength may be used for the substrate 54*a*, and stainless steel (SUS) is excellent in price and strength and thus is suitably used for a metal substrate. In a case in which any of a ceramic substrate and a metal substrate is used as the substrate 54*a*, and the substrate has conductivity, it is required that the substrate be used with an insulating layer provided thereto. The heat generating elements 54*b*1*a*, 54*b*1*b*, 54*b*2, and 54*b*3, the conductor 54*c*, and the contacts 54*d*1 to 54*d*4 are formed on the substrate 54*a*. Further, the protection glass layer 54*e* is formed thereon to secure insulation between the heat generating elements 54*b*1*a*, 54*b*1*b*, 54*b*2, and 54*b*3 and a film 51.

The heat generating elements 54*b* are different in length (hereinafter also referred to as size) in the longitudinal direction. The heat generating elements 54*b*1*a* and 54*b*1*b* each have a length of L1=222 mm, which is a first length, in the longitudinal direction. The heat generating element 54*b*2 has a length of L2=188 mm, which is a second length, in the longitudinal direction. The heat generating element 54*b*3 has a length of L3=154 mm, which is a third length, in the longitudinal direction. The lengths L1, L2, and L3 have a relationship of L1>L2>L3.

Moreover, the largest sheet width (hereinafter referred to as a maximum sheet width) in a sheet P which can be used in the image forming apparatus 170 according to Embodiment 1 is 216 mm, and the smallest sheet width (hereinafter referred to as a minimum sheet width) is 76 mm. Thus, the first length L1 is set to such a length that an image size (206 mm) having the maximum sheet width (216 mm) can be fixed by the heat generating elements 54*b*1. The heat generating elements 54*b*1 are electrically connected to the contact 54*d*2 being a second contact and the contact 54*d*4 being a fourth contact via the conductor 54*c*, and the heat generating element 54*b*2 is electrically connected to the contacts 54*d*2 and 54*d*3 via the conductor 54*c*. The heat generating element 54*b*3 is electrically connected to the contact 54*d*1 being a first contact and the contact 54*d*3 being a third contact via the conductor 54*c*. Here, the heat generating element 54*b*1*a* and the heat generating element 54*b*1*b* have the same lengths and are always used substantially at the same time. The heat generating element 54*b*1*a* is provided at one end portion in a widthwise direction of the substrate 54*a*, and the heat generating element 54*b*1*b* is provided at another end portion in the widthwise direction of the substrate 54*a*. The heat generating elements 54*b*2 and 54*b*3 are provided between the heat generating element 54*b*1*a* and the heat generating element 54*b*2*b* in the widthwise direction of the substrate 54*a* in such a manner as to be symmetrical with respect to a center in the widthwise direction.

The fixing temperature sensor 59 is a thermistor. A configuration of the fixing temperature sensor 59 is described with reference to FIG. 4B. The fixing temperature sensor 59 being a temperature detection unit is formed of a main thermistor element 59*a*, a holder 59*b*, a ceramic paper 59*c*, and an insulation resin sheet 59*d*. The ceramic paper 59*c* has a role of hindering heat conduction between the holder 59*b* and the main thermistor element 59*a*. The insulation resin sheet 59*d* has a role of physically and electrically protecting the main thermistor element 59*a*. The main thermistor element 59*a* is a temperature detecting unit having an output value that is changed in accordance with the temperature of the heater 54, and it is connected to the CPU 94 through a Dumet wire (not shown) and wiring. The main thermistor element 59*a* detects the temperature of the heater 54 and outputs a detection result to the CPU 94.

The fixing temperature sensor 59 is located on a surface opposite to the protection glass layer 54*e* over the substrate 54*a*. Further, the fixing temperature sensor 59 is installed in contact with the substrate 54*a* at a position on the reference line "a" (position corresponding to the center) in the longitudinal direction of the heat generating element 54*b*. The CPU 94 is configured to control the temperature at the time of fixing processing based on the detection result of the fixing temperature sensor 59. The above is the description as to the configuration of the fixing temperature sensor 59 being a main thermistor.

FIG. 5 is a schematic diagram of a power control circuit for the heater 54 and fixing power controller 97 of the fixing device 50. The power control circuit of the fixing device 50 includes the heat generating elements 54*b*1, the heat generating elements 54*b*2 and 54*b*3, an alternating-current power source 55, the triac 56*a*, the triac 56*b*, the triac 56*c*, and the heat generating element switcher 57. The contact 54*d*1 is connected to the triac 56*c*, and it is connected to a first pole of the alternating-current power source 55 via the triac 56*c*. The contact 54*d*2 is connected to the heat generating element switcher 57 and a second pole of the alternating-current power source 55. The contact 54*d*3 is connected to the triac 56*b* and the heat generating element switcher 57, and it is connected to the first pole of the alternating-current power source 55 via the triac 56*b*. The contact 54*d*4 is connected to the triac 56*a*, and it is connected to the first pole of the alternating-current power source 55 via the triac 56*a*. The heat generating element switcher 57 switches the heat generating element 54*b* that generates heat by switching between power supply paths. The switch from one power supply path to another is therefore also expressed as the switch between the heat generating elements 54*b*. In Embodiment 1, the heat generating element switcher 57 is specifically an electromagnetic relay that has a normally open contact configuration. The triacs 56*a*, 56*b*, and 56*c* are triacs that supply power or cut power supply to the heat generating elements 54*b*1 and the heat generating elements 54*b*2 and 54*b*3 from the alternating-current power source 55 by turning conductive or non-conductive. The CPU 94 calculates, based on temperature information informed by the main thermistor element 59*a*, power required to bring the heater 54 to a given temperature (a target temperature required for fixing), and instructs the triacs 56*a*, 56*b*, and 56*c* to turn conductive or non-conductive. The heat generating element switcher 57, which is an electromagnetic relay, is controlled by the engine controller 92 to reach one of a state in which the contact 54*d*2 and the contact 54*d*3 are connected and a state in which the connection between the contact 54*d*2 and the contact 54*d*3 is cut.

[Power Supply Path]

Figure 6A:
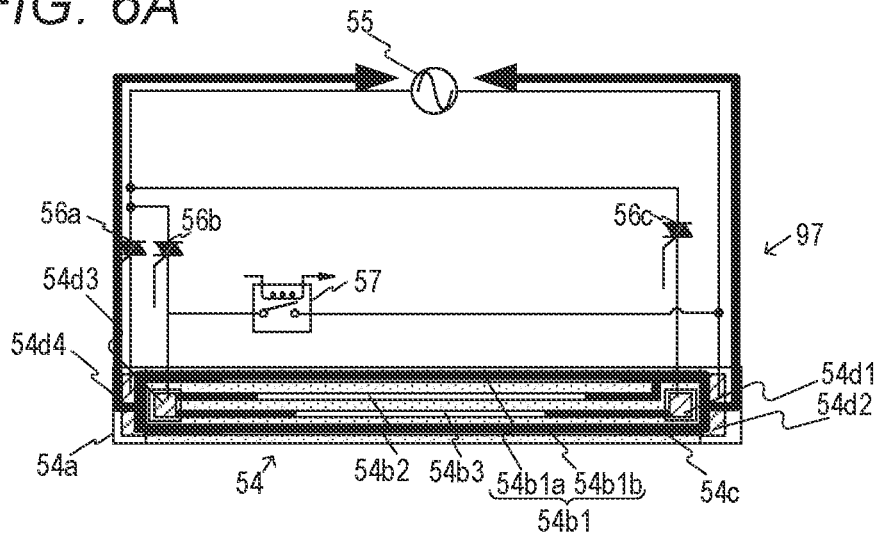
FIG. 6A, FIG. 6B, and FIG. 6C are schematic diagrams for illustrating three current paths to three types of heat generating elements in Embodiment 1.
Figure 6B:
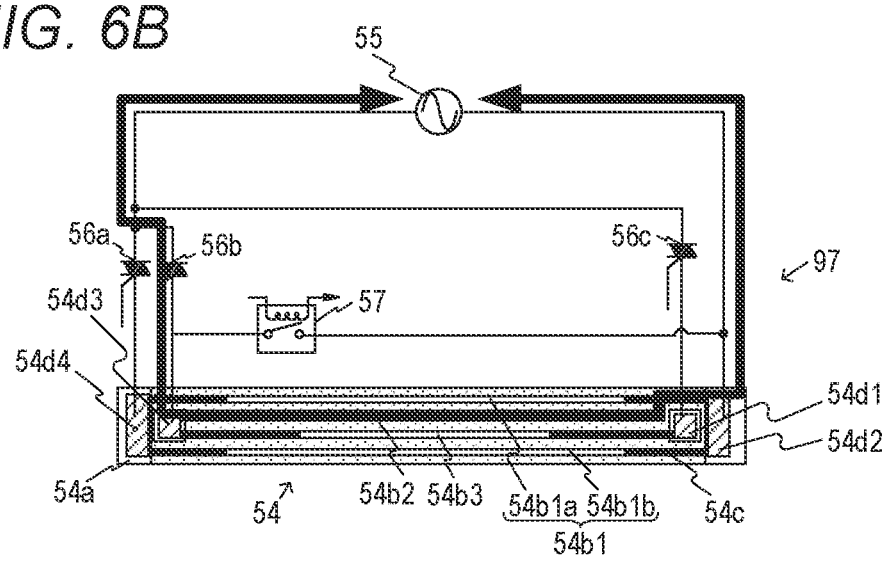
Figure 6C:
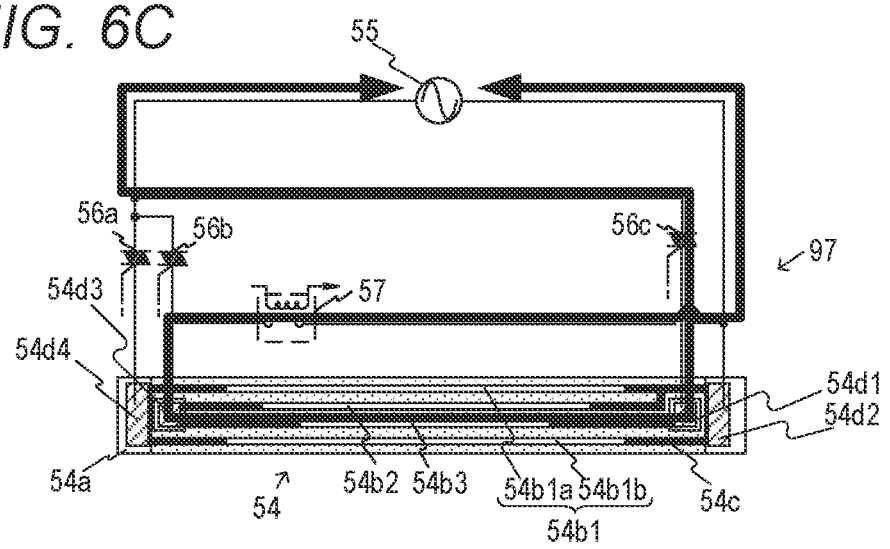

A method of supplying power by alternately switching between the heat generating elements 54*b*1 and the heat generating element 54*b*2, and between the heat generating elements 54*b*1 and the heat generating element 54*b*3 is described next. The heater 54 provided with three types of heat generating elements varied in length, which are the heat generating elements 54*b*1 and the heat generating elements 54*b*2 and 54*b*3, and three current paths (which are electrical paths as well as power supply paths) to the heat generating elements 54*b*1 to 54*b*3 are illustrated in FIG. 6A, FIG. 6B, and FIG. 6C. The current paths illustrated in FIG. 6A, FIG. 6B, and FIG. 6C are merely an example, and other current path configurations may be used.

(Power Supply to the Heat Generating Elements 54*b*1)

In the case of power supply from the alternating-current power source 55 to the heat generating elements 54*b*1, an electric current flows along a route indicated by the bold line in FIG. 6A. The fixing temperature sensor 59 (not shown in FIG. 6A) detects the temperature of the heater 54 and, based on the temperature information about the detected temperature, the CPU 94 causes the triac 56*a* to operate in a manner that brings the detection result of the fixing temperature sensor 59 to the given temperature. This controls power supply to the heat generating elements 54*b*1. Power supply to the heat generating elements 54*b*1 is independent of the states of the heat generating elements 54*b*2 and 54*b*3 and the heat generating element switcher 57, which is an electromagnetic relay having a normally open contact configuration. That is, the heat generating element switcher 57 can be in an open state and a short-circuited state when power is supplied to the heat generating elements 54*b*1. In FIG. 6A, the heat generating element switcher 57 is in the open state as an example.

(Power Supply to the Heat Generating Element 54*b*2)

In the case of power supply from the alternating-current power source 55 to the heat generating element 54*b*2, an electric current flows along a route indicated by the bold line in FIG. 6B. For power supply to the heat generating element 54*b*2, the contact of the heat generating element switcher 57, which is an electromagnetic relay having a normally open contact configuration, is set to the open state. When in the open state, the heat generating element switcher 57 having the normally open contact configuration is sufficiently greater in contact impedance than the heat generating element 54*b*2, and heat generation in the heat generating element 54*b*2 alone is therefore accomplished with substantially no current flowing into the heat generating element switcher 57 having the normally open contact configuration. Power supplied to the heat generating element 54*b*2 is controlled by the triac 56*b*.

(Power Supply to the Heat Generating Element 54*b*3)

In the case of power supply from the alternating-current power source 55 to the heat generating element 54*b*3, an electric current flows along a route indicated by the bold line in FIG. 6C. For power supply to the heat generating element 54*b*3, the contact of the heat generating element switcher 57, which is an electromagnetic relay having a normally open contact configuration, is set to the short-circuited state, and almost all of the electric current therefore flows in the heat generating element 54*b*3. When in the short-circuited state, the heat generating element switcher 57 having the normally open contact configuration is sufficiently smaller in contact impedance than the heat generating element 54*b*2, and heat generation in the heat generating element 54*b*3 alone is therefore accomplished with substantially no current flowing into the heat generating element 54*b*2. Power supplied to the heat generating element 54*b*3 is controlled by the triac 56*c*.

[Switching of Power Supply Paths]

For switching between the power supply path (FIG. 6A) to the heat generating elements 54*b*1 and the power supply path (FIG. 6B) to the heat generating element 54*b*2, the contact of the heat generating element switcher 57 having the normally open contact configuration is set to the open state in advance. This enables independent control solely with non-contact switches that are the triac 56*a* and the triac 56*b*. Accordingly, seamless transition of the state between the power supply path of FIG. 6A and the power supply path of FIG. 6B, as well as the use of the power supply path of FIG. 6B along with the power supply path of FIG. 6A, are accomplished.

The same applies to the power supply path (FIG. 6A) to the heat generating elements 54*b*1 and the power supply path (FIG. 6C) to the heat generating element 54*b*3. As described above, the heat generating element switcher 57 can be in the open state and the short-circuited state in the case of the power supply path of FIG. 6A. The setting of the contact of the heat generating element switcher 57 having the normally open contact configuration to the short-circuited state in advance therefore enables seamless transition of the state between the power supply path of FIG. 6A and the power supply path of FIG. 6C, as well as the use of the power supply path of FIG. 6C along with the power supply path of FIG. 6A.

For switching between the power supply path (FIG. 6B) of the heat generating element 54*b*2 and the power supply path (FIG. 6C) of the heat generating element 54*b*3, on the other hand, the heat generating element switcher 57 having the normally open contact configuration is required to switch states. The power supply path (FIG. 6C) to the heat generating element 54*b*3 therefore cannot be used along with the power supply path of FIG. 6B. That is, only one of the power supply path of FIG. 6B and the power supply path of FIG. 6C can be used, which means that those paths are exclusive of each other.

However, transition between the power supply path of FIG. 6B and the power supply path of FIG. 6C is executable by, for example, state transition to the power supply path of FIG. 6C from the power supply path of FIG. 6B via the power supply path of FIG. 6A, or state transition to the power supply path of FIG. 6B from the power supply path of FIG. 6C via the power supply path of FIG. 6A. Both cases include the insertion of a transition to the power supply path of FIG. 6A in a transition between the power supply path of FIG. 6B and the power supply path of FIG. 6C. During the use of the power supply path of FIG. 6A, in other words, during power supply to the heat generating elements 54*b*1, the state of the heat generating element switcher 57 having the normally open contact configuration is switched from the open state to the short-circuited state, or from the short-circuited state to the open state. This prevents a situation in which power supply to the heater 54 is suspended in order to wait for the stabilization of the state of the contact of the heat generating element switcher 57 having the normally open contact configuration and, consequently, a required quantity of heat cannot be supplied to the sheet P.

[Selection of the Heat Generating Element Suitable for Sheet Size]

The selection of a heat generating element in printing on a large-sized sheet and printing on a small-sized sheet is described with reference to Table 1.

TABLE 1

| | Case 1 Large-sheet printing | Case 2 Small-Sheet Printing 1 | Case 3 Small-Sheet Printing 2 |
|---|---|---|---|
| Sheet width | 216 mm to 182 mm | 182 mm to 148 mm | 148 mm to 76 mm |
| Heat generating element | Heat generating elements 54b1 | Heat generating elements 54b1 and heat generating element 54b2 | Heat generating elements 54b1 and heat generating element 54b3 |

In Table 1, the width of the sheet P (sheet width) and the heat generating elements to be selected are shown for each case. In the second column, a sheet width and the heat generating elements to be selected in large-sheet printing are shown as Case 1. In the third column, a sheet width and the heat generating elements to be selected in Small-Sheet Printing 1 are shown as Case 2. In the fourth column, a sheet width and the heat generating elements to be selected in Small-Sheet Printing 2 are shown as Case 3. In Embodiment 1, when the sheet P specified by a user has a width more than 182 mm and equal to or less than 216 mm, the sheet P is referred to as "large-sized sheet", printing on the large-sized sheet is referred to as "large-sheet printing", and the heat generating elements 54*b* are selected and controlled accordingly. Only the heat generating elements 54*b*1 are used to generate heat in large-sheet printing of Case 1 in Table 1.

In small-sheet printing, on the other hand, a heat generating element having a minimum width that covers the width of the sheet to be printed on is turned on in addition to the heat generating elements 54*b*1, which have the full width. However, in printing on a small-sized sheet that has a sheet width ending within 3 mm from the ends of the heat generating element 54*b*, a wider heat generating element is selected in consideration of an error in the conveyance position of the sheet P in the longitudinal direction.

Specifically, when the sheet P specified by the user has a width more than 148 mm and equal to or less than 182 mm, the sheet P is referred to as "Small-Sized Sheet 1", printing on Small-Sized Sheet 1 is referred to as "Small-Sheet Printing 1", and the heat generating elements 54*b* are selected and controlled accordingly. A typical size of the sheet P that corresponds to Small-Sheet Printing 1 in Case 2 of Table 1 is the size B5. In Small-Sheet Printing 1, the heat generating element 54*b*2 is used to generate heat along with the heat generating elements 54*b*1. When the sheet P specified by the user has a width equal to or more than 76 mm and equal to or less than 148 mm, the sheet P is referred to as "Small-Sized Sheet 2", printing on Small-Sized Sheet 2 is referred to as "Small-Sheet Printing 2", and the heat generating elements 54*b* are selected and controlled accordingly. Typical sizes of the sheet P that correspond to Small-Sheet Printing 2 in Case 3 of Table 1 are the size A5 and the size A6. In Small-Sheet Printing 2, the heat generating element 54*b*3 is used to generate heat along with the heat generating elements 54*b*1.

In small-sheet printing (Case 2 and Case 3), the temperature of the heat generating elements 54*b*1, which have the full width, and the temperature of the narrow-width heat generating element 54*b*2 or 54*b*3 are controlled so that a temperature detected by the fixing temperature sensor 59 reaches a predetermined target temperature at a power ratio that is determined in advance based on the warmth level of the fixing device 50. In Embodiment 1, the temperature control is described with the use of a configuration in which the heat generating element 54*b*2 or the heat generating element 54*b*3 is used to generate heat along with the heat generating elements 54*b*1. However, a configuration in which the heat generating elements 54*b*1 and the heat generating element 54*b*2, or the heat generating elements 54*b*1 and the heat generating element 54*b*3, are alternately and exclusively used to generate heat may also be employed.

The warmth level of the fixing device 50 is an index represent of the extent of temperature rise (the heating state, the degree of temperature rise) in the fixing device 50. A method of setting the warmth level in Embodiment 1 is described with reference to Table 2. For example, five stages from Warmth Level 1, which indicates a cooled down state of the fixing device 50, to Warmth Level 5, at which the fixing device 50 can be regarded as being thermally saturated, are set as the warmth level. A warmth index is assigned to each stage of the warmth level. The warmth level is determined by adding to a warmth index that corresponds to the print mode and, when the warmth index exceeds 20, shifts to the next stage of the warmth level.

TABLE 2

| Warmth level | 1 | 2 | 3 | 4 | 5 |
|---|---|---|---|---|---|
| Warmth index | 0 to 19 | 20 to 39 | 40 to 59 | 60 to 79 | 80 or more |
| Temperature detection threshold value | 0° C. or more | 60° C. or more | 80° C. or more | 100° C. or more | 130° C. or more |

In Table 2, the warmth level, the warmth index, and a threshold value for temperature detection (temperature detection threshold value) are shown in the first row, the second row, and the third row, respectively. The second column indicates the warmth index and the temperature detection threshold value at Warmth Level 1, and the third column indicates the warmth index and the temperature detection threshold value at Warmth Level 2. The fourth column indicates the warmth index and the temperature detection threshold value at Warmth Level 3, the fifth column indicates the warmth index and the temperature detection threshold value at Warmth Level 4, and the sixth column indicates the warmth index and the temperature detection threshold value at Warmth Level 5. When the warmth index determined by the addition calculation is 25, for example, the warmth level is 2 and the threshold value for temperature detection is 60° C. or higher.

[Warmth Level Determination Processing]

Figure 7:
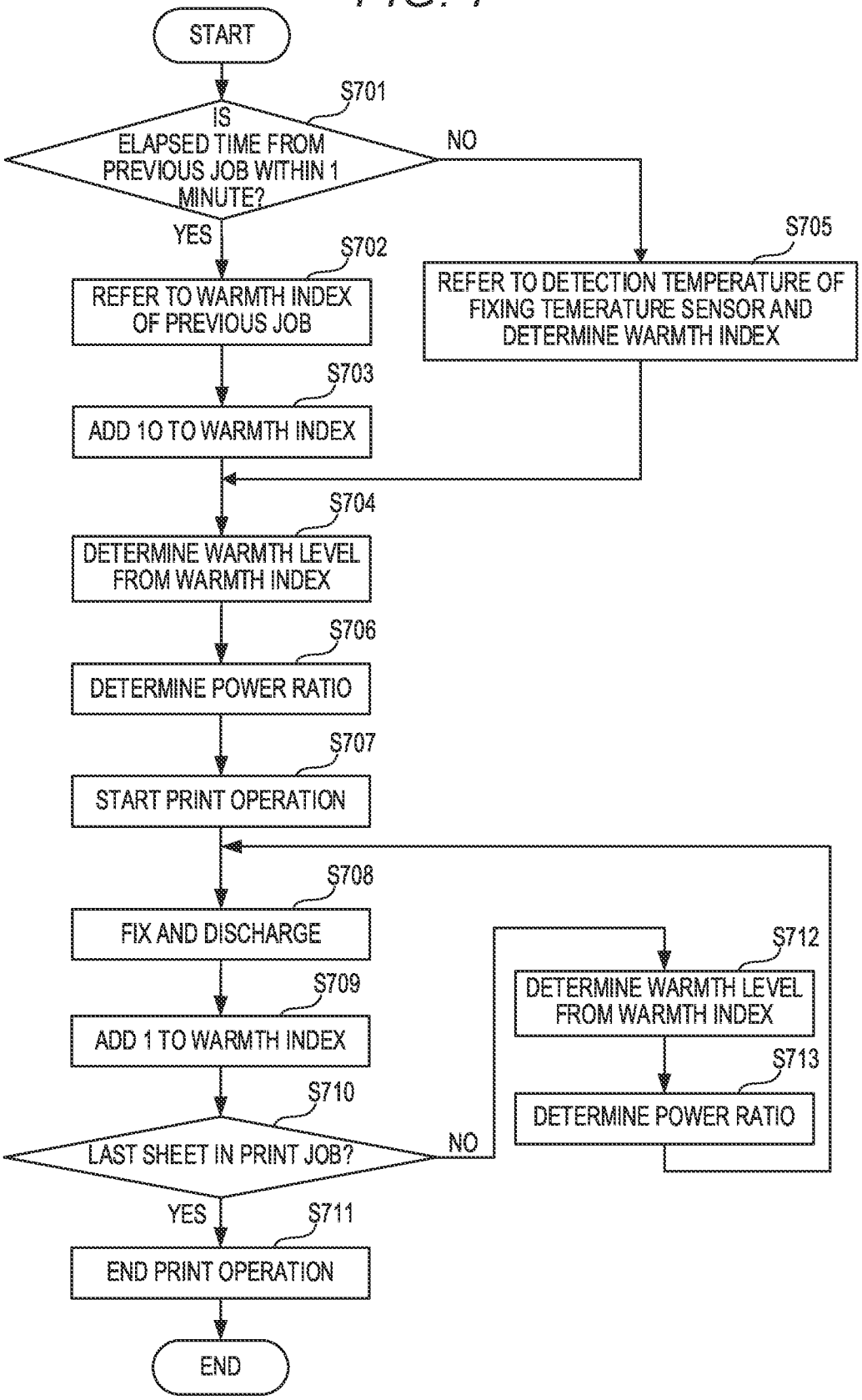
FIG. 7 is a flow chart for illustrating counting processing of a warmth index in Embodiment 1 and Embodiment 2.

A method of determining the warmth level is described with reference to FIG. 7, which is a flow chart for illustrating warmth level determination processing. The CPU 94 receives a print signal and executes Step S701 and subsequent processing steps. The method of determining the warmth level is roughly divided into two methods, depending on the time elapsed from the immediately preceding print job.

In Step S701, the CPU 94 determines whether the time elapsed from the end of the immediately preceding print job (hereinafter referred to as "previous job") is within 1 minute at the time of reception of the print signal by the image forming apparatus 170. When it is determined in Step S701 that the elapsed time is within 1 minute ("yes" in Step S701), the CPU 94 advances the processing to Step S702. When it is determined that the elapsed time exceeds 1 minute ("no" in Step S701), the CPU 94 advances the processing to Step S705. In Step S702, the CPU 94 refers to the warmth index in the previous job, namely, the immediate last warmth index. The immediate last warmth index is, for example, a warmth index obtained in the previous job and stored on the memory 95. In Step S703, the CPU 94 adds 10 to the warmth index referred to in Step S702. In Step S704, the CPU 94 determines the warmth level from the warmth index to which 10 has been added in Step S703, based on Table 2. When the warmth index calculated by adding 10 is 25, for example, the CPU 94 determines the warmth level as Level 2 based on Table 2.

In Step S705, due to the time elapsed since the previous job, the CPU 94 refers to a temperature detected by the fixing temperature sensor 59 to determine the warmth index based on Table 2. In Step S704, the CPU 94 determines the warmth level based on the warmth index that has been determined in Step S705, and on Table 2. When the temperature detected by the fixing temperature sensor 59 is 60° C., for example, the CPU 94 determines the warmth index as, for example, 20 based on Table 2, and determines the warmth level as 2. The warmth index calculated by the addition in Step S703 or determined in Step S705 is used in Step S709 described later.

In Step S706, the CPU 94 uses the warmth level determined in Step S704 to refer to a table and determine the power ratio of the heat generating elements 54*b*1 and the heat generating element 54*b*2, or the power ratio of the heat generating elements 54*b*1 and the heat generating element 54*b*3. The table referred to in determining the power ratio is described later. In Step S707, the CPU 94 starts print operation with the use of the power ratio determined in Step S706. In Step S708, the CPU 94 prints on as many sheets P as a number specified by the received print signal, performs fixing processing on the sheets P, and then discharges the sheets P. In Step S709, the CPU 94 adds 1 to the warmth index each time a sheet is printed on, in other words, each time one sheet P is passed through the fixing device 50. The CPU 94 stores information of the warmth index on which the addition has been performed in, for example, the memory 95. In Step S710, the CPU 94 determines whether the sheet P that has just been passed through the fixing device 50 is the last sheet P (last sheet) in the consecutive printing of the instructed print job. When it is determined in Step S710 that the passed sheet is the last sheet P in the consecutive printing ("yes" in Step S710), the CPU 94 ends the print operation in Step S711 and ends the processing. When it is determined in Step S710 that the passed sheet is not the last sheet P in the consecutive printing ("no" in Step S710), the CPU 94 advances the processing to Step S712. In Step S712, the CPU 94 determines the warmth level based on the warmth index on which 1 has been added in Step S709, and on Table 2. In Step S713, the CPU 94 determines a power ratio for the next printing (specifically, fixing processing), based on the warmth level determined in Step S712 and on the table described later, and then returns the processing to Step S708. In the case of consecutive printing, the addition to the warmth index, the determination of the warmth level, the determination of the power ratio, and fixing/discharging are thus repeated for each printing.

(About Deformation of the Film)

The fixing processing is executed with the use of the heat generating elements 54*b*1, which are large in width, and the heat generating element 54*b*2 even for a small-sized sheet in order to prevent deformation of the film 51 by uniformly transmitting heat to the entire length of the fixing nip portion N in the longitudinal direction, and thus evenly softening the grease on the inner surface of the film 51.

The cause of deformation of the film 51 is described in detail, taking Small-Sheet Printing 1 as an example. When the fixing device 50 in a cooled down state executes fixing operation using only the heat generating element 54*b*2, which is small in width, the viscosity of the grease becomes different in outer areas (at both ends) and an inner area (in a central part) in the longitudinal direction of the heat generating element 54*b*2. This applies a twisting force to the film 51, and the force may deform the film 51. In an area of the fixing nip portion N in which the heat generating element 54*b*2 is present in the longitudinal direction, the temperature rises due to a supply of power to the heat generating element 54*b*2. This lowers the viscosity of the grease, thereby causing a sliding load between the film 51 and the heater 54 to drop.

In an area of the fixing nip portion N in which the heat generating element 54*b*2 is absent and only the heat generating elements 54*b*1 are present in the longitudinal direction, on the other hand, a supply of power to the heat generating element 54*b*2 does not cause a large temperature rise in the fixing nip portion N. The grease accordingly maintains high viscosity and the sliding load remains high without dropping. For those reasons, when the film 51 rotates by following the rotation of the pressure roller 53, a force is applied that causes a difference in the rotation speed of the film 51 between the central part in the longitudinal direction in which the heat generating element 54*b*2 is present and end portions in the longitudinal direction in which the heat generating element 54*b*2 is absent. The force may twist and deform the film 51 when the strength of the film 51 is not high enough. This is more prominent in Small-Sheet Printing 2, in which the area with only the heat generating elements 54*b*1 present is wider.

On one hand, the heat generating elements 54*b*1 having the full width are required to be turned on in order to prevent the deformation of the film 51 as described above, but the heat generating elements 54*b*1 having the full width are large in non-sheet passing portion area through which a small-sized sheet does not pass, and are accordingly prone to a large temperature rise in the non-sheet passing portion. This is addressed by varying the power ratio of the heat generating elements 54*b*1 having the full width to the heat generating element 54*b*2 or the heat generating element 54*b*3 between Small-Sheet Printing 1 and Small-Sheet Printing 2, which is a feature of Embodiment 1. The proportion of power supplied to the heat generating elements 54*b*1 having the full width to power supplied to the heat generating element 54*b*2 small in size in Small-Sheet Printing 1 is referred to as "power ratio R1". The proportion of power supplied to the heat generating elements 54*b*1 having the full width to power supplied to the heat generating element 54*b*3 small in size in Small-Sheet Printing 2 is referred to as "power ratio R2". The power ratio R2 in Small-Sheet Printing 2 is set smaller than the power ratio R1 in Small-Sheet Printing 1 (R1>R2).

In Embodiment 1, power is supplied to the heat generating elements 54*b* at the power ratio R1 in Small-Sheet Printing 1 that is shown in Table 3, and at the power ratio R2 in Small-Sheet Printing 2 that is shown in Table 3. Table 3 is a table used to determine the power ratio. Small-Sheet Printing 1 corresponds to a first mode, and Small-Sheet Printing 2 corresponds to a second mode.

TABLE 3

| | Power ratio | Warmth level 1 | 2 | 3 | 4 | 5 |
|---|---|---|---|---|---|---|
| Small-Sheet Printing 1 | R1 | 50% | 35% | 30% | 25% | 20% |
| Small-Sheet Printing 2 | R2 | 45% | 25% | 20% | 15% | 10% |

Table 3 is a table used to determine the power ratio R1 of Small-Sheet Printing 1 and the power ratio R2 of Small-Sheet Printing 2. The power ratio R1 (%) and the power ratio R2 (%) are each set for Warmth Levels 1 to 5 described with reference to Table 2. For example, the power ratio R1 of the heat generating elements 54*b*1 having the full width to the heat generating element 54*b*2 in Small-Sheet Printing 1 at Warmth Level 1 is set to approximately 50%. At the same Warmth Level 1, the power ratio R2 of the heat generating elements 54*b*1 having the full width to the heat generating element 54*b*3 in Small-Sheet Printing 2 is set to approximately 45% (<50%). The power ratios R1 and R2 at the same warmth level are set so that the power ratio R2 is lower than the power ratio R1. The power ratio R2 in Small-Sheet Printing 2 is lower than the power ratio R1 in Small-Sheet Printing 1 at the other warmth levels as well.

In Small-Sheet Printing 2, the sheet P to be printed on has a width narrower than the one in Small-Sheet Printing 1, and the heat generating elements 54*b*1 having the full width is accordingly large in the width of the non-sheet passing portion. The fixing temperature sensor 59 is located in a sheet-passing portion around the center, and the passage of the small-sized sheet through the sheet passing portion therefore causes the temperature at the position of the fixing temperature sensor 59 to drop. In short, the temperature of the film 51 in the sheet passing portion is controlled so as to reach a target temperature because temperature control is performed in the sheet passing portion. The non-sheet passing portion, which receives a supply of heat from the heat generating elements 54*b*1 similarly to the sheet passing portion, under monitoring by the fixing temperature sensor 59 located in the sheet passing portion, on the other hand, does not experience a loss of heat caused by the sheet P and accordingly has a temperature higher than that in the sheet-passing portion. In Small-Sheet Printing 2, the width of the non-sheet passing portion is wider than in Small-Sheet Printing 1, and the temperature rise in the non-sheet passing portion accordingly tends to be large. A ratio at which the heat generating elements 54*b*1 are turned on (in other words, a power ratio) is therefore set lower in Small-Sheet Printing 2 than in Small-Sheet Printing 1, to thereby suppress the temperature rise of the film 51 in the non-sheet passing portion.

<Effect>

The effect of suppressing temperature rise in the non-sheet passing portion described above is described with the use of Embodiment 1 and a comparative example. The comparative example is an image forming apparatus having the same configuration as the one in Embodiment 1, and setting the power ratio of the full-width heat generating elements 54*b*1 to the heat generating element 54*b*2 in Small-Sheet Printing 1 and the power ratio of the full-width heat generating elements 54*b*1 to the heat generating element 54*b*3 in Small-Sheet Printing 2 as the same ratio. In the comparative example, the power ratio R1 of Table 3 is used in both of Small-Sheet Printing 1 and Small-Sheet Printing 2.

Figure 8:
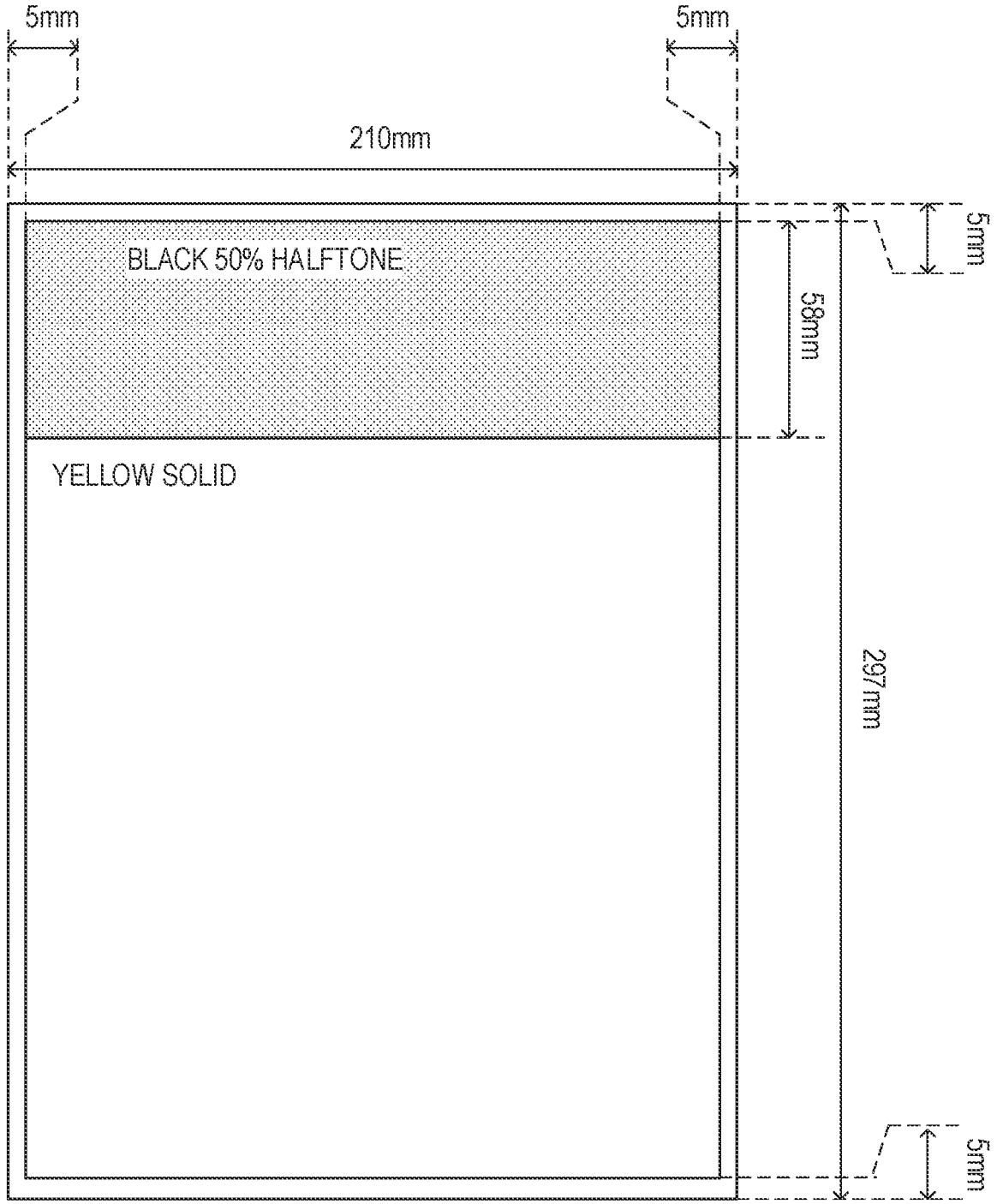
FIG. 8 is a diagram for illustrating a print image in Embodiment 1.

An evaluation method is described. In Embodiment 1 and the comparative example, evaluation was performed by executing consecutive printing of a given number of Size A5 sheets that have a basis weight of 64 g/m$^2$ (for example, PB PAPER manufactured by Canon Inc.), printing one Size A4 sheet of the same type immediately after the consecutive printing, and repeating the process with the number of Size A5 sheets to be printed varied. A character image having a coverage rate of 5% was used as a Size A5 print image. FIG. 8 is a diagram for illustrating the sheet and the image. With regard to a print image on the Size A4 sheet (210 mm×297 mm), as illustrated in FIG. 8, a 50% halftone image in a single color of black (Bk) was printed for a stretch of 58 mm from the front end, and a solid image having a coverage rate of 100% was printed in a single color of yellow (Y) after the first 58 mm from the front end. A margin of 5 mm was provided at each of the front and the rear end in the conveyance direction, and the ends (the left end and the right end) in a direction orthogonal to the conveyance direction.

A case in which hot offset images were formed in end portions (non-sheet passing portions of the Size A5 sheets) of a print image on the Size A4 sheet was evaluated as x, and a case in which no hot offset images were formed was evaluated as ○. Results of the evaluation are shown in Table 4.

TABLE 4

| | Number of Size A5 sheets passed | | | | | | | | |
|---|---|---|---|---|---|---|---|---|---|
| | 1 | 3 | 5 | 8 | 10 | 15 | 20 | 50 | 100 |
| Embodiment 1 | o | o | o | o | o | o | o | o | o |
| Comparative Example | o | o | o | x | x | x | x | x | x |

In Table 4, the numbers of Size A5 sheets passed (1 sheet to 100 sheets) and whether hot offset images were formed in Embodiment 1 and the comparative example are shown. With the configuration of Embodiment 1, no hot offset images were formed on the subsequent Size A4 sheet regardless of the number of Size A5 sheets or Size B5 sheets printed (1 sheet to 100 sheets). With the configuration of the comparative example, on the other hand, when the number of Size A5 sheets printed was eight or higher, hot offset images were formed in the immediately subsequent printing of the Size A4 sheet in areas corresponding to the outside of the Size A5 sheet. Here, hot offset images were formed on the Size A4 sheet after the printing of the Size A5 sheets, which is Small-Sheet Printing 2, because the power ratios of Small-Sheet Printing 1 and Small-Sheet Printing 2 were set to the power ratio R1 of Table 3 as the comparative example. However, when the power ratios of Small-Sheet Printing 1 and Small-Sheet Printing 2 are set to the power ratio R2 of Table 3, cold offset is likely to occur in this case on the Size A4 sheet after the printing of the Size B5 sheets, which is Small-Sheet Printing 1.

As described above, the configuration of Embodiment 1 includes at least three heat generating elements varying in width in the longitudinal direction: the first heat generating element having a full width, which corresponds to a sheet of a maximum sheet passing width; the second heat generating element narrower in width than the first heat generating element; and the third heat generating element further narrower in width. In fixing operation for fixing on a small-sized sheet, the first heating element and the second heating element, or the first heating element and the third heating element, are selected depending on the width of the small-sized sheet, and the selected heat generating elements are caused to simultaneously generate heat. In this configuration, the power ratio of the first heat generating element in the fixing operation that is executed by a combination of the first heat generating element and the second heat generating element is set higher than the power ratio of the first heat generating element in the fixing operation that is executed by a combination of the first heat generating element and the third heat generating element. This enables a reduction of the temperature rise in the non-sheet passing portion that is caused by the first heat generating element also when the heat generating elements that are used are the combination of the first heat generating element and the third heat generating element for fixing on a sheet further narrower in width. As a result, a temperature difference between the sheet passing portion and the non-sheet passing portion of the pressure roller 53 and the film 51 immediately after a small-sized sheet is passed for printing is reduced, and the occurrence of hot offset can accordingly be mitigated.

[Another Fixing Power Controller]

Figure 9:
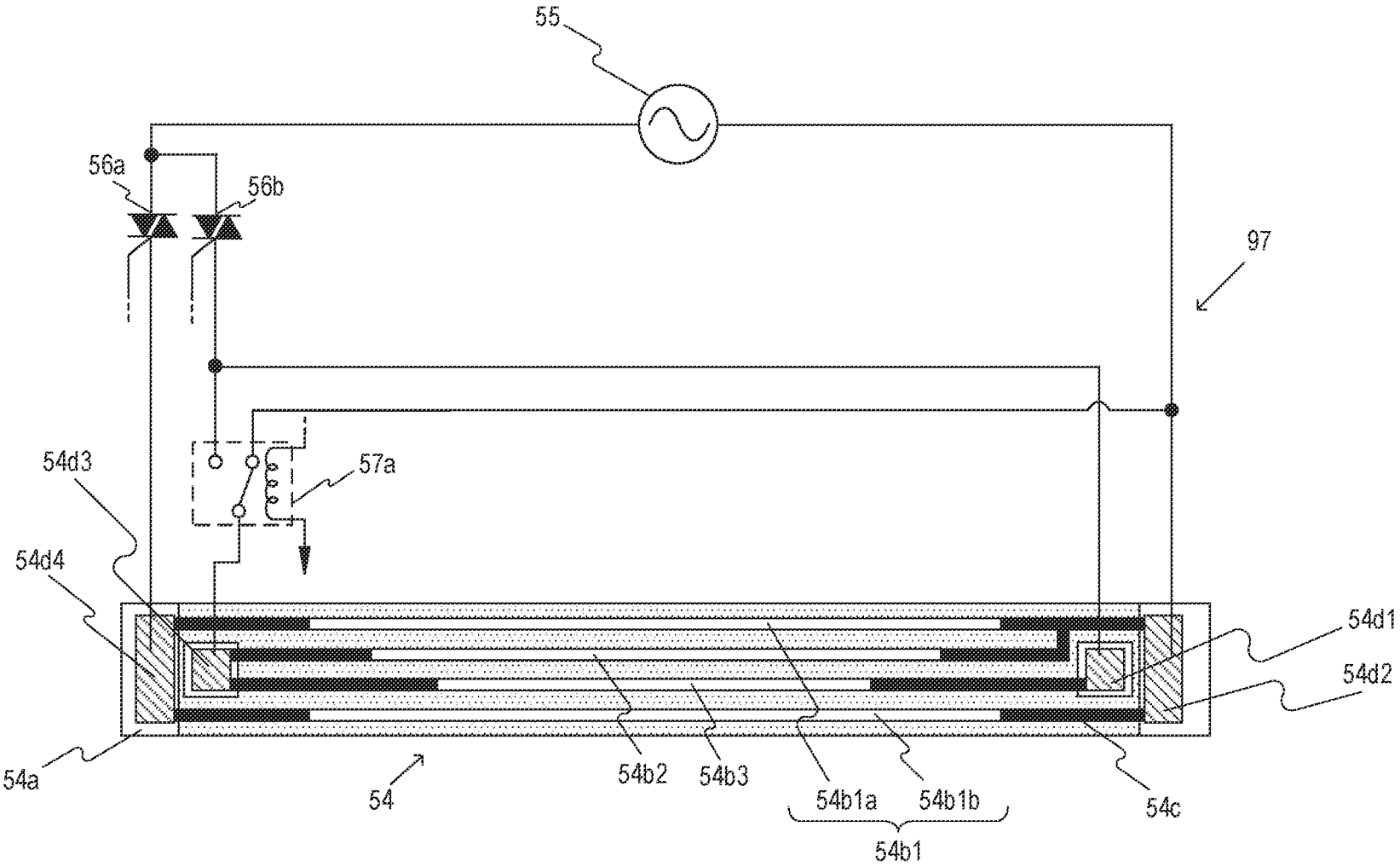
FIG. 9 is a schematic diagram of another power control circuit in Embodiment 1.

In Embodiment 1, a configuration in which a different triac 56 is used for each of the three types of heat generating elements 54*b* to supply power. However, the method of supplying power to the heat generating elements 54*b* is not limited thereto. FIG. 9 is a diagram for illustrating a configuration of another fixing power controller. Components in FIG. 9 that are the same as those in FIG. 5 are denoted by the same reference symbols and descriptions thereof are omitted. As illustrated in FIG. 9 as an example of an employable configuration, the triac 56*a* may be connected to the heat generating elements 54*b*1, and a heat generating element switcher 57*a*, which is a transfer contact relay, may be used to switch between the heat generating element 54*b*2 and the heat generating element 54*b*3 from one triac 56*b*.

As described above, according to Embodiment 1, image defects can be reduced by reducing the temperature difference between the sheet passing portion and the non-sheet passing portion in the fixing nip portion.

Embodiment 2

In a configuration of the image forming apparatus 170 that is employed in Embodiment 2, components that are the same as those in Embodiment 1 are denoted by the same reference symbols, and descriptions thereof are omitted. In Embodiment 2, as illustrated in FIG. 9, the triac 56*a*, which is a first connection unit, is connected to the heat generating elements 54*b*1, and a transfer contact relay serves as the heat generating element switcher 57*a* configured to switch between the heat generating element 54*b*2 and the heat generating element 54*b*3, and selects from the heat generating elements 54*b*. Power to the heat generating element 54*b*2 or the heat generating element 54*b*3 is supplied with the triac 56*b*.

[Selection of Heat Generating Element Suitable for Sheet Size]

In the image forming apparatus 170 according to Embodiment 2, the selection of the heat generating elements 54*b* suitable for the width of the sheet P to be printed on differs from the selection in Embodiment 1. The selection of the heat generating elements 54*b* in printing on a large-sized sheet and printing on small-sized sheets of different sizes is described with reference to Table 5.

TABLE 5

| | Case 4 Large-sheet printing | Case 5 Small-Sheet Printing 3 | Case 6 Small-Sheet Printing 4 | Case 7 Small-Sheet Printing 5 | Case 8 Small-Sheet Printing 6 |
|---|---|---|---|---|---|
| Sheet width | 216 mm to 198 mm | 198 mm to 182 mm | 182 mm to 164 mm | 164 mm to 148 mm | 148 mm to 76 mm |

TABLE 5-continued

| | Case 4 Large-sheet printing | Case 5 Small-Sheet Printing 3 | Case 6 Small-Sheet Printing 4 | Case 7 Small-Sheet Printing 5 | Case 8 Small-Sheet Printing 6 |
|---|---|---|---|---|---|
| Heat generating element | heat generating elements 54b1 | Heat generating elements 54b1 and heat generating element 54b2 | Heat generating elements 54b1 and heat generating element 54b2 | Heat generating elements 54b1 and heat generating element 54b3 | Heat generating elements 54b1 and heat generating element 54b3 |

In Table 5, the width of the sheet P (sheet width) and the heat generating elements 54*b* to be selected are shown for each case. In the second column, a sheet width and the heat generating elements to be selected in large-sheet printing are shown as Case 4. In the third column, a sheet width and the heat generating elements to be selected in Small-Sheet Printing 3 are shown as Case 5. In the fourth column, a sheet width and the heat generating elements to be selected in Small-Sheet Printing 4 are shown as Case 6. In the fifth column, a sheet width and the heat generating elements to be selected in Small-Sheet Printing 5 are shown as Case 7. In the sixth column, a sheet width and the heat generating elements to be selected in Small-Sheet Printing 6 are shown as Case 8. Small-Sheet Printing 3 and Small-Sheet Printing 4 correspond to the first mode, and Small-Sheet Printing 5 and Small-Sheet Printing 6 correspond to the second mode.

In Embodiment 2, when the sheet P specified by the user has a width more than 198 mm, the printing of the sheet P is referred to as large-sheet printing, and the heat generating elements 54*b* are selected and controlled accordingly. In large-sheet printing of Case 4 in Table 5, only the heat generating elements 54*b*1 are used to generate heat. In small-sheet printing, on the other hand, the heat generating element 54*b*2 or the heat generating element 54*b*3 is used depending on the width of the sheet P, to generate heat, in addition to the heat generating elements 54*b*1, which have the full width. Specifically, when the sheet P specified by the user has a width more than 164 mm and equal to or less than 198 mm, the printing of the sheet P uses the heat generating elements 54*b*1 and the heat generating element 54*b*2. In that range, the printing of the sheet P having a width more than 182 mm is referred to as "Small-Sheet Printing 3" (Case 5 in Table 5), and the printing of the sheet P having a width more than 164 mm and equal to or less than 182 mm is referred to as "Small-Sheet Printing 4" (Case 6 in Table 5).

When the specified sheet P has a width equal to or more than 76 mm and equal to or less than 164 mm, the printing of the sheet P uses the heat generating elements 54*b*1 and the heat generating element 54*b*3. In that range, the printing of the sheet P having a width more than 148 mm is referred to as "Small-Sheet Printing 5" (Case 7 in Table 5), and the printing of the sheet P having a width more than 76 mm and equal to or less than 148 mm is referred to as "Small-Sheet Printing 6" (Case 8 in Table 5).

As described with reference to FIG. 4A, L2 is 188 mm and the width of the sheet P may accordingly be larger than the width of the heat generating element 54*b*2 in Case 5. The width of the sheet P may exceed the width of the heat generating element 54*b*3 in Case 7 because L3 is 154 mm. That is, in Small-Sheet Printing 3, the heat generating element 54*b*2 is used along with the heat generating elements 54*b*1 having the full width even when the ends of the sheet P fall outside the heat generating element 54*b*2. Similarly, in Small-Sheet Printing 5, the heat generating element 54*b*3 is used along with the heat generating elements 54*b*1 having the full width even when the ends of the sheet P fall outside the heat generating element 54*b*3. In each of those cases, an image area in which a toner image may be on the sheet P is located on the inside of the heat generating element 54*b*2 or the heat generating element 54*b*3. In other words, in Small-Sheet Printing 3, the sheet width of the sheet P is sometimes larger than the width of the heat generating element 54*b*2, but a maximum image formation width is smaller than the width of the heat generating element 54*b*2. In Small-Sheet Printing 5, the sheet width of the sheet P is sometimes larger than the width of the heat generating element 54*b*3, but the maximum image forming width is smaller than the width of the heat generating element 54*b*3. The maximum image forming width is the largest width of tonner images formed on the sheet P. This enables, in printing on a sheet having a width corresponding to Small-Sheet Printing 3 or Small-Sheet Printing 5, a reduction of the quantity of heat supplied to the non-sheet passing portion, in addition to the effect of Embodiment 1, and the productivity of printing can thus be raised.

The power ratio of two types of heat generating elements, namely, the heat generating elements 54*b*1 having the full width and the heat generating element 54*b*2, or the heat generating elements 54*b*1 having the full width and the heat generating element 54*b*3, differs between Small-Sheet Printing 3 and Small-Sheet Printing 4, or between Small-Sheet Printing 5 and Small-Sheet Printing 6. The power ratios of the heat generating elements 54*b*1 having the full width to the heat generating element 54*b*2 in Small-Sheet Printing 4 and to the heat generating element 54*b*3 in Small-Sheet Printing 6 are denoted by R4 and R6, respectively, and the power ratios R4 and R6 are the same as the power ratios R1 and R2, respectively, in Embodiment 1. Power ratios R in Small-Sheet Printing 3 to Small-Sheet Printing 6 are shown in Table 6.

TABLE 6

| | | Warmth level | | | | |
|---|---|---|---|---|---|---|
| | Power ratio | 1 | 2 | 3 | 4 | 5 |
| Small-Sheet Printing 3 | R3 | 95% | 85% | 80% | 75% | 70% |
| Small-Sheet Printing 4 | R4 | 50% | 35% | 30% | 25% | 20% |
| Small-Sheet Printing 5 | R5 | 90% | 80% | 75% | 70% | 65% |
| Small-Sheet Printing 6 | R6 | 45% | 25% | 20% | 15% | 10% |

As shown in Table 6, the power ratios R3 and R5 of the heat generating elements 54*b*1 having the full width in Small-Sheet Printing 3 and Small-Sheet Printing 5 are higher than the power ratios R4 and R6 in Small-Sheet Printing 4 and Small-Sheet Printing 6 (R3>R4, R5>R6). The reason for this is described taking Small-Sheet Printing 3 as an example. In printing on the sheet P that has a width of 198 mm, the end portions of the sheet P fall outside the heat generating element 54*b*2. The fixing of toner images near the end portions of the sheet P requires not only a quantity of heat supplied from the heat generating elements 54*b*1 and the heat generating element 54*b*2 to the sheet passing portion but also a quantity of heat supplied from the heat generating elements 54*b*1 to the non-sheet passing portion.

Figure 10A:
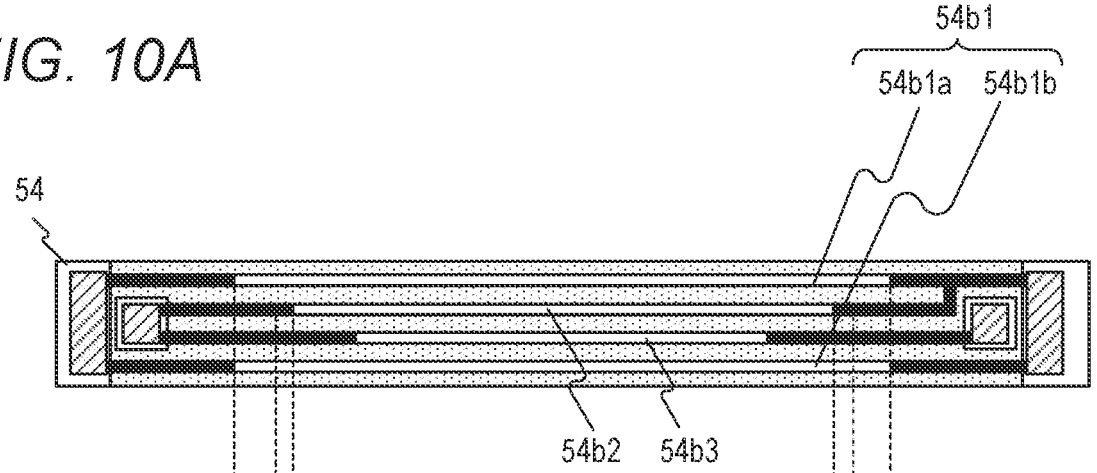
FIG. 10A is a schematic sectional view of the heater.
Figure 10B:
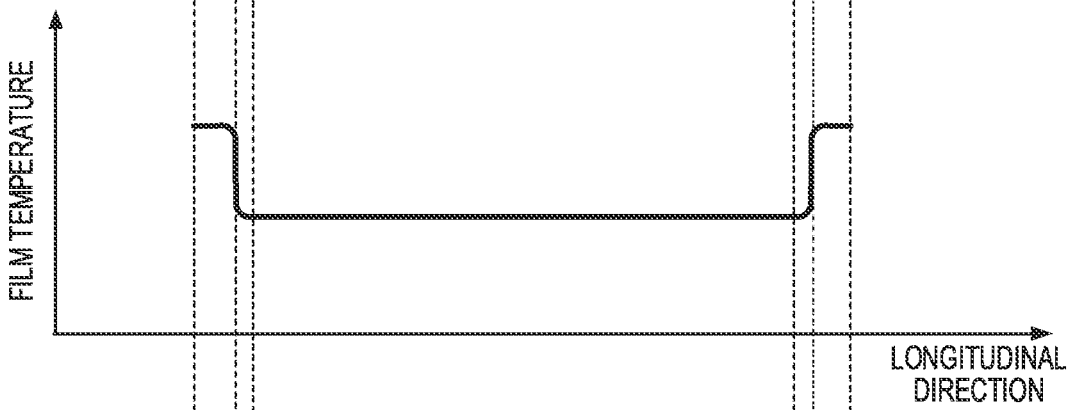
FIG. 10B and FIG. 10C are schematic graphs for showing the temperature of a fixing film in Embodiment 2.
Figure 10C:
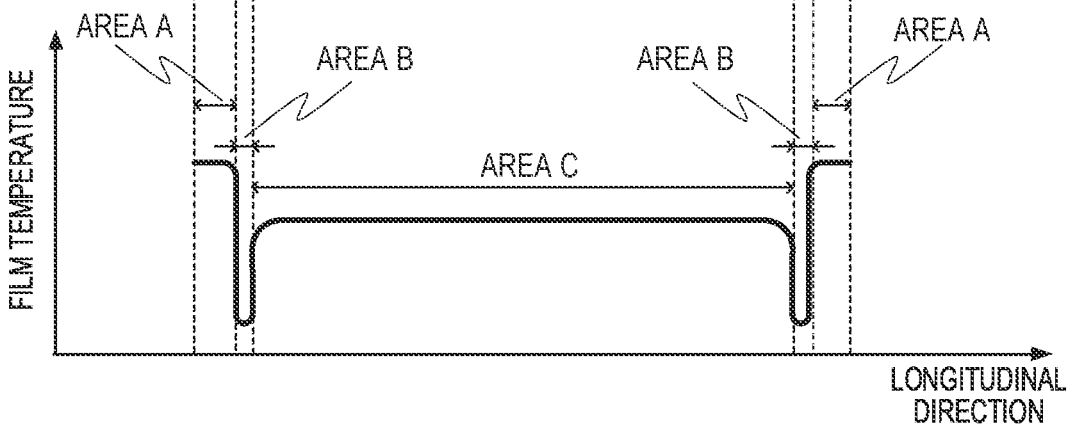

Details thereof are described with reference to FIG. 10A, FIG. 10B, and FIG. 10C. FIG. 10A is a schematic sectional view of the heater 54. FIG. 10B is a schematic graph of a temperature distribution that is observed in the film 51 in the longitudinal direction when printing on the 198 mm-wide sheet P given above as an example is executed at the power ratio R3 described in Embodiment 2. FIG. 10C, on the other hand, is a schematic graph of a temperature distribution that is observed in the film 51 in the longitudinal direction when printing is executed at the power ratio R1. In FIG. 10B and FIG. 10C, the position in the longitudinal direction is plotted on the horizontal axis and the temperature of the film 51 (film temperature) is plotted on the vertical axis. The horizontal axis corresponds to the heat generating elements 54*b* (54*b*1*a* (54*b*1), 54*b*1*b* (54*b*1), 54*b*2, and 54*b*3) of the heater 54 illustrated in FIG. 10A.

Areas A in FIG. 10C are non-sheet passing portions. Areas B in FIG. 10C are sheet passing portions outside the heat generating element 54*b*2. In Embodiment 2, the areas B are non-image portions. An area C in FIG. 10C is an image portion in which a toner image can be formed. The areas A and the areas B are supplied with heat basically from the heat generating elements 54*b*1, and the area C is supplied with heat from the heat generating element 54*b*2 as well as the heat generating elements 54*b*1. The areas B and the area C are sheet passing portions and are accordingly areas that lose heat by the passage of the sheet P. In FIG. 10C, despite the loss of heat in the areas B due to the sheet P, the temperature of the film 51 drops because the power ratio R1 of the heat generating elements 54*b*1 is low. This may affect a toner image that reaches the end portions of the adjacent Area C, resulting in defective fixing. In Embodiment 2 shown in FIG. 10B, on the other hand, a large quantity of heat is supplied to the areas B at the high power ratio R3 of the heat generating elements 54*b*1, and a drop in the temperature of the film 51 is accordingly mitigated, which reduces defective fixing.

As described above, Embodiment 2 includes at least three heat generating elements varying in width in the longitudinal direction: the first heat generating element having a full width, which corresponds to a sheet of a maximum sheet passing width; the second heat generating element narrower in width than the first heat generating element; and the third heat generating element further narrower in width. In fixing operation for fixing on a small-sized sheet, the first heating element and the second heating element, or the first heating element and the third heating element, are selected depending on the width of the small-sized sheet, and the selected heat generating elements are caused to generate heat substantially simultaneously. Even for the printing of a small-sized sheet whose ends fall outside the second heating element or the third heating element, when an area in which an image can be formed falls on the inside of the second heat generating element or the third heat generating element, fixing processing is executed with the use of the first heat generating element and the second heat generating element, or the first heat generating element and the third heat generating element. This reduces the temperature rise described above as a phenomenon occurring in the non-sheet passing portion in the printing on a sheet small in sheet width, to raise the productivity of printing, and simultaneously mitigate hot offset that is caused by printing on a small-sized sheet.

As described above, according to Embodiment 2, image defects can be reduced by reducing the temperature difference between the sheet passing portion and the non-sheet passing portion in the fixing nip portion.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-162958, filed Sep. 6, 2019, which is hereby incorporated by reference herein in its entirety.

What is claimed is:

1. An image forming apparatus, comprising:

a fixing device including a heater, a first rotary member, a second rotary member, and a temperature detection unit, the heater including a first heat generating element and a second heat generating element shorter in length in a longitudinal direction than the first heat generating element, the first rotary member being heated by the heater, the second rotary member forming a nip portion together with the first rotary member; and a control unit configured to control a temperature of the heater based on a detection result of the temperature detection unit, wherein power supply to the first heat generating element and power supply to the second heat generating element are exclusive of each other, wherein, in a case in which a temperature detected by the temperature detection unit is a first temperature, a ratio of a heat generation amount of the first heat generating element to a heat generation amount of the second heat generating element is a first value, and in a case in which the temperature detected by the temperature detection unit is a second temperature, the ratio of the heat generation amount of the first heat generating element to the heat generation amount of the second heat generating element is a second value, and wherein the second temperature is higher than the first temperature, and the second value is smaller than the first value.

2. The image forming apparatus according to claim 1, wherein the first rotary member comprises a film.

3. The image forming apparatus according to claim 2, wherein the heater is provided so as to be in contact with an inner surface of the film, and wherein the nip portion is formed by sandwiching the film between the heater and the second rotary member.

4. The image forming apparatus according to claim 1, wherein the heater further includes a third heat generating element shorter in length in the longitudinal direction than the second heat generating element.

5. The image forming apparatus according to claim 4, wherein the image forming apparatus is operable in a first mode in which power is supplied to the first heat generating element and the second heat generating element and in a second mode in which power is supplied to the first heat generating element and the third heat generating element, and wherein the ratio of the heat generation amount of the first heat generating element to the heat generation amount of the second heat generating element in the first mode is larger than a ratio of the heat generation amount of the first heat generating element to a heat generation amount of the third heat generating element in the second mode.

6. The image forming apparatus according to claim 5, wherein a sheet width, which is a length in the longitudinal direction, of a recording material to be printed in the first mode is shorter than a length of the second heat generating element in the longitudinal direction, and wherein a sheet width of a recording material to be printed in the second mode is shorter than a length of the third heat generating element in the longitudinal direction.

7. The image forming apparatus according to claim 5, wherein a maximum image formation width, which is a width in the longitudinal direction of a toner image largest of toner images to be formed on a recording material in the first mode, is shorter than a length of the second heat generating element in the longitudinal direction, and wherein the maximum image formation width of toner images to be formed on a recording material in the second mode is shorter than a length of the third heat generating element in the longitudinal direction.

8. The image forming apparatus according to claim 7, wherein, in the first mode, the ratio in printing on a recording material having a sheet width that is longer than the length of the second heat generating element in the longitudinal direction is higher than the ratio in printing on a recording material having a sheet width that is shorter than the length of the second heat generating element in the longitudinal direction.

9. The image forming apparatus according to claim 7, wherein, in the second mode, the ratio in printing on a recording material having a sheet width that is longer than the length of the third heat generating element in the longitudinal direction is higher than the ratio in printing on a recording material having a sheet width that is shorter than the length of the third heat generating element in the longitudinal direction.

10. The image forming apparatus according to claim 4, wherein the heater includes an elongated substrate on which the first heat generating element, the second heat generating element, and the third heat generating element are arranged, wherein the first heat generating element is arranged on one end portion of the elongated substrate in a widthwise direction orthogonal to both a longitudinal direction of the elongated substrate and a thickness direction of the elongated substrate, wherein the heater includes a fourth heat generating element arranged on another end portion in the widthwise direction of the substrate so that the fourth heat generating element is symmetric with the first heat generating element, and wherein the second heat generating element and the third heat generating element are arranged between the first heating element and the fourth heating element in the widthwise direction of the substrate.

11. The image forming apparatus according to claim 10, wherein the second heat generating element and the third heat generating element are arranged so as to be symmetric with each other in the widthwise direction of the substrate.

12. The image forming apparatus according to claim 10, further comprising:

a fourth contact to which one end portion of the first heat generating element and one end portion of the fourth heat generating element are electrically connected;

a second contact to which another end portion of the first heat generating element, another end portion of the fourth heat generating element, and another end portion of the second heat generating element are electrically connected;

a third contact to which one end portion of the second heat generating element and one end portion of the third heat generating element are electrically connected; and a first contact to which another end portion of the third heat generating element is electrically connected.

13. The image forming apparatus according to claim 4, wherein the second heat generating element is supplied with power along with the first heat generating element, and wherein the third heat generating element is supplied with power along with the first heat generating element.

14. The image forming apparatus according to claim 4, wherein the power supply to the second heat generating element and power supply to the third heat generating element are exclusive of each other.

* * * * *